US008096670B2

(12) United States Patent
Trott et al.

(10) Patent No.: US 8,096,670 B2
(45) Date of Patent: Jan. 17, 2012

(54) LIGHT FIXTURES, LIGHTING DEVICES, AND COMPONENTS FOR THE SAME

(75) Inventors: Gary David Trott, Morrisville, NC (US); Paul Kenneth Pickard, Morrisville, NC (US); Edward Roger Adams, Englewood, TN (US); Antony Paul Van De Ven, Hong Kong (CN)

(73) Assignee: Cree, Inc., Durham, NC (US)

( * ) Notice: Subject to any disclaimer, the term of this patent is extended or adjusted under 35 U.S.C. 154(b) by 680 days.

(21) Appl. No.: 11/948,041

(22) Filed: Nov. 30, 2007

(65) Prior Publication Data

US 2008/0137347 A1 Jun. 12, 2008

Related U.S. Application Data

(60) Provisional application No. 60/861,901, filed on Nov. 30, 2006, provisional application No. 60/916,384, filed on May 7, 2007.

(51) Int. Cl.
*F21S 8/02* (2006.01)

(52) U.S. Cl. ..... 362/147; 362/364; 362/277

(58) Field of Classification Search ..... 362/147, 362/148, 269, 277, 322, 355, 364
See application file for complete search history.

(56) References Cited

U.S. PATENT DOCUMENTS

| | | | | |
|---|---|---|---|---|
| 4,356,540 | A * | 10/1982 | Goralnik | 362/294 |
| 4,910,650 | A * | 3/1990 | Goralnik | 362/147 |
| 7,320,536 | B2 * | 1/2008 | Petrakis et al. | 362/364 |
| 2002/0109983 | A1 | 8/2002 | Bonazzi | |
| 2003/0193811 | A1 | 10/2003 | Mullen | |
| 2005/0265016 | A1 | 12/2005 | Rappaport | |
| 2006/0164844 | A1 | 7/2006 | To | |

FOREIGN PATENT DOCUMENTS

| | | |
|---|---|---|
| CN | 2563423 Y | 7/2003 |
| DE | 299 00 951 | 6/2000 |
| DE | 299 09 041 | 6/2000 |
| DE | 102 07 542 | 9/2003 |
| EP | 0 589 744 | 3/1994 |
| EP | 1 006 311 | 6/2000 |
| EP | 1 400 746 | 3/2004 |
| FR | 2 669 098 | 5/1992 |
| FR | 2 683 616 | 5/1993 |

OTHER PUBLICATIONS

U.S. Appl. No. 11/859,048, filed Sep. 21, 2007.
U.S. Appl. No. 11/877,038, filed Oct. 23, 2007.

* cited by examiner

*Primary Examiner* — Sharon Payne
(74) *Attorney, Agent, or Firm* — Burr & Brown

(57) ABSTRACT

A diffuser for a lighting device comprises a diffuser region, a hook element and a nose element. A light fixture comprises a housing with an opening and a diffuser as described above, in which the nose element extends through the opening, optionally further comprising an accessory including at least one spring element engaging the hook element. A light fixture structure comprises a housing defining an opening and an first attachment element comprising a nose element, a hook element and a connection region, and optionally further comprising a diffuser engaging a first portion of the hook element, and/or an accessory which engages a second portion of the hook element. An eyeball accessory comprises first and second housing elements pivotably attached to each other. An accessory for a light fixture comprises a housing member and a spring element engageable with a fixture.

46 Claims, 14 Drawing Sheets

LIGHT FIXTURES, LIGHTING DEVICES, AND COMPONENTS FOR THE SAME

CROSS-REFERENCE TO RELATED APPLICATIONS

This application claims the benefit of U.S. Provisional Patent Application No. 60/861,901, filed Nov. 30, 2006, the entirety of which is incorporated herein by reference.

This application also claims the benefit of U.S. Provisional Patent Application No. 60/916,384, filed May 7, 2007, the entirety of which is incorporated herein by reference.

FIELD OF THE INVENTION(S)

The present inventive subject matter relates to light fixtures, lighting devices and components for light fixtures and lighting devices. In some aspects, the present inventive subject matter relates to removable and replaceable accessories for light fixtures.

BACKGROUND OF THE INVENTION(S)

There exist a number of different types of light fixture accessories. One example of a light fixture accessory is an "eyeball" fixture, i.e., a downlight with the capability to "push" light preferentially off axis (typically toward a wall or other structure).

Traditional implementations of "eyeball" downlights suffer from a number of shortcomings. First, in some instances, the eyeball features are integral to the downlight fixture, requiring a specific fixture to be purchased for that purpose. (Some "eyeball" trims can be used interchangeably with other trims in a standard fixture.) Second, the "eyeball", a hemispherical protrusion from the ceiling plane with an opening to direct light, typically extends into the room area to a significant degree, which can be considered by some people to be obtrusive and unattractive. And third, especially in compact fluorescent fixtures, the "eyeball" fixture is often extremely inefficient, wasting significant amounts of the light generated by the lamp.

BRIEF SUMMARY OF THE INVENTION(S)

It would be desirable to provide light fixture accessories which can readily be removed and/or attached to light fixtures. Such devices would enable a user to easily change the type and/or pattern of light emitted from one or more light fixtures. In addition, such devices would result in an overall reduction on SKU numbers for a line of light fixtures, because each component could be assigned an SKU, rather than having to assign an SKU to each combination of light fixture and accessory.

In addition, it would be desirable to improve the performance of various light fixture accessories. For example, in the case of eyeball fixture accessories, it would be desirable to provide a product which is less obtrusive into the room space, for which kick angles (and aimability) can be more effectively controlled, and/or which result in improved energy efficiency (e.g., by blocking less light emitted by the light emitter attached to the light fixture).

According to a first aspect of the present inventive subject matter, there is provided a diffuser for a lighting device, the diffuser comprising a diffuser region, a hook element, at least a first nose element, a first connection region and a second connection region, the first connection region being attached to the diffuser region, the first nose element being attached to the first connection region, the second connection region being attached to the diffuser region, the hook element being attached to the second connection region, the nose element extending farther in a first direction than the first connection region extends in a second direction, the first direction being parallel to the second direction, the first direction and the second direction each being perpendicular to a first axis which passes through at least a portion of each of the first nose element and the first connection region, at least a portion of the hook element extending farther in a third direction than the second connection region extends in a fourth direction, the third direction and the fourth direction each being perpendicular to a second axis which passes through at least a portion of each of the hook element and the second connection region, wherein if light passes through the diffuser region, the light would be diffused by passing through the diffuser region.

In some embodiments according to this aspect of the present inventive subject matter, a major dimension of the diffuser region extends in a first plane, the first plane being perpendicular to the first axis.

In some embodiments according to this aspect of the present inventive subject matter, the hook element extends around an entire periphery of the diffuser. In some such embodiments, the periphery is substantially circular.

In some embodiments according to this aspect of the present inventive subject matter, a surface of the diffuser region is substantially circular.

In some embodiments according to this aspect of the present inventive subject matter, the diffuser further comprises a second nose element, a third connection region, a third nose element and a fourth connection region, the third connection region extending from the diffuser region to the second nose element, the fourth connection region extending from the diffuser region to the third nose element.

According to a second aspect of the present inventive subject matter, there is provided a light fixture, comprising:

a light engine housing, the light engine housing defining at least a first opening; and a diffuser, the diffuser comprising a diffuser region, at least a first nose element, a first connection region, a hook element and a second connection region, the first connection region being attached to the diffuser region, the first nose element being attached to the first connection region, the second connection region being attached to the diffuser region, the hook element being attached to the second connection region, the nose element extending farther in a first direction than the first connection region extends in a second direction, the first direction being parallel to the second direction, the first direction and the second direction each being perpendicular to a first axis which passes through at least a portion of each of the first nose element and the first connection region, the first nose element being positioned on an opposite side of the first opening relative to the first hook element, the first connection portion extending through the first opening, at least a portion of the hook element extending farther in a third direction than the second connection region extends in a fourth direction, the third direction and the fourth direction each being perpendicular to a second axis which passes through at least a portion of each of the hook element and the second connection region, wherein if light passes through the diffuser region, the light would be diffused by passing through the diffuser region.

In some embodiments according to this aspect of the present inventive subject matter, a major dimension of the diffuser region extends in a first plane, the first plane being perpendicular to the first axis.

In some embodiments according to this aspect of the present inventive subject matter, the hook element extends around an entire periphery of the diffuser. In some such embodiments, the periphery is substantially circular.

In some embodiments according to this aspect of the present inventive subject matter, a surface of the diffuser region is substantially circular.

In some embodiments according to this aspect of the present inventive subject matter, the diffuser further comprises a second nose element, a third connection region, a third nose element and a fourth connection region, the third connection region extending from the diffuser region to the second nose element, the fourth connection region extending from the diffuser region to the third nose element.

According to a third aspect of the present inventive subject matter, there is provided a light fixture, comprising:

a light engine housing, the light engine housing defining at least a first opening;

a diffuser; and at least one accessory, the diffuser comprising a diffuser region, at least a first nose element, a first connection region, a hook element and a second connection region, the diffuser comprising a first peripheral edge;

the first connection region being attached to the diffuser region, the first nose element being attached to the first connection region, the second connection region being attached to the diffuser region, the hook element being attached to the second connection region, the nose element extending farther in a first direction than the first connection region extends in a second direction, the first direction being parallel to the second direction, the first direction and the second direction each being perpendicular to a first axis which passes through at least a portion of each of the first nose element and the first connection region, the first nose element being positioned on an opposite side of the first opening relative to the first hook element, the first connection portion extending through the first opening, at least a portion of the hook element extending farther in a third direction than the second connection region extends in a fourth direction, the third direction and the fourth direction each being perpendicular to a second axis which passes through at least a portion of each of the hook element and the second connection region, wherein if light passes through the diffuser region, the light would be diffused by passing through the diffuser region, the accessory comprising a second peripheral edge and at least a first spring element, the accessory being held in place relative to the diffuser by at least the first spring element, the accessory being of a shape such that if the accessory were not engaged with the diffuser, the first spring element would be in a first position in which it extends away from the second peripheral edge when no pressure is applied to the first spring element, wherein if the accessory is pushed toward the diffuser such that a first region surrounded by the first peripheral edge of the diffuser at least partially overlaps a second region surrounded by the second peripheral edge of the accessory, the first spring element would be pushed toward the second peripheral edge due to contact between a first surface of the first spring element with the hook element, and if the accessory is pushed further, the first spring element would reach a position relative to the hook element where the first spring element can move at least partially back toward the first position such that a second surface of the first spring element would come into contact with the hook element, whereby the accessory would be held in place relative to the diffuser due to at least contact between the second surface of the first spring element and the hook element.

In some embodiments according to this aspect of the present inventive subject matter, the first spring element is biased to extend inward from the second peripheral edge when no pressure is applied to the first spring element, wherein if the accessory is pushed toward the diffuser such that the first region surrounded by the first peripheral edge of the diffuser at least partially overlaps the second region surrounded by the second peripheral edge of the accessory, the first spring element would be pushed outward toward the second peripheral edge due to contact between the first surface of the first spring element with the hook element, and if the accessory is pushed further, the first spring element would reach a position where it is no longer pushed outward by contact with the hook element, and the first spring element would return toward the first position, such that the first spring element would extend inward from the second peripheral edge and a second surface of the first spring element would be in contact with the hook element, whereby the accessory would be held in place relative to the diffuser due to at least contact between the second surface of the first spring element and the hook element. In some such embodiments, if the diffuser is positioned such that a first plane defined by a surface of the diffuser region is substantially level, the first spring element would be pushed in a direction which is substantially parallel to the first plane, and the accessory would be held in place relative to the diffuser as a result of at least gravitational force pulling the second surface of the first spring element toward the hook element, and/or in some such embodiments, the first spring element comprises at least a third surface which is sloped such that the first spring element would be pushed outward or inward gradually as the accessory is pushed toward the diffuser such that the first region surrounded by the first peripheral edge of the diffuser would at least partially overlap a second region surrounded by the second peripheral edge of the accessory.

In some embodiments according to this aspect of the present inventive subject matter, the first spring element is biased to extend outward from the second peripheral edge when no pressure is applied to the first spring element, wherein if the accessory is pushed toward the diffuser such that the first region surrounded by the first peripheral edge of the diffuser at least partially overlaps the second region surrounded by the second peripheral edge of the accessory, the first spring element would be pushed inward toward the second peripheral edge due to contact between the first surface of the first spring element with the hook element, and if the accessory is pushed further, the first spring element would reach a position where it is no longer pushed inward by contact with the hook element, and the first spring element would return toward the first position, such that the first spring element would extend outward from the second peripheral edge and a second surface of the first spring element would be in contact with the hook element, whereby the accessory would be held in place relative to the diffuser due to at least contact between the second surface of the first spring element and the hook element.

In some embodiments according to this aspect of the present inventive subject matter, the accessory is rotatable relative to the light engine housing.

In some embodiments according to this aspect of the present inventive subject matter, the first peripheral edge and the second peripheral edge are each substantially circular. In some such embodiments, the accessory is rotatable relative to the light engine housing about an axis extending through a center of a circle defined by the first peripheral edge.

In some embodiments according to this aspect of the present inventive subject matter, the accessory comprises at least the first spring element, a second spring element and a third spring element.

In some embodiments according to this aspect of the present inventive subject matter, a surface of the diffuser region extends in a first plane, the first plane being perpendicular to the first axis.

In some embodiments according to this aspect of the present inventive subject matter, a surface of the diffuser region is substantially circular.

In some embodiments according to this aspect of the present inventive subject matter, the hook element extends around an entire periphery of the diffuser.

In some embodiments according to this aspect of the present inventive subject matter, the diffuser further comprises a second nose element, a third connection region, a third nose element and a fourth connection region, the third connection region extending from the diffuser region to the second nose element, the fourth connection region extending from the diffuser region to the third nose element.

According to a fourth aspect of the present inventive subject matter, there is provided a light fixture structure, comprising:

a light engine housing, the light engine housing defining at least a first opening; and at least a first attachment element, the first attachment element comprising at least a first nose element, a hook element and a first connection region, the first connection region extending from the first nose element to the hook element, the first nose element extending farther in a first direction than the first connection region extends in a second direction, the first direction being parallel to the second direction, the first direction and the second direction each being perpendicular to a first axis which passes through at least a portion of each of the first nose element and the first connection region, the first nose element being positioned on an opposite side of the first opening relative to the hook element, the first connection region extending through the first opening, at least a portion of the hook element extending farther in a third direction than the first connection region extends in the second direction, the third direction also being perpendicular to the first axis.

In some embodiments according to this aspect of the present inventive subject matter, an edge of the hook element extends around an entire periphery of the attachment element, the periphery of the attachment element being substantially circular.

According to a fifth aspect of the present inventive subject matter, there is provided a light fixture, comprising:

a light engine housing, the light engine housing defining at least a first opening;

a diffuser, the diffuser comprising a diffuser region; and at least a first attachment element, the first attachment element comprising at least a first nose element, a hook element and a first connection region, the first connection region extending from the first nose element to the hook element, the first nose element extending farther in a first direction than the first connection region extends in a second direction, the first direction being parallel to the second direction, the first direction and the second direction each being perpendicular to a first axis which passes through at least a portion of each of the first nose element and the first connection region, the first nose element being positioned on an opposite side of the first opening relative to the hook element, the first connection region extending through the first opening, at least a portion of the hook element extending farther in a third direction than the first connection region extends in the second direction, the third direction also being perpendicular to the first axis, at least a first surface of the diffuser being in contact with a portion of the hook element, wherein if light passes through the diffuser region, the light would be diffused by passing through the diffuser region.

In some embodiments according to this aspect of the present inventive subject matter, a major dimension of the diffuser region extends in a first plane, the first plane being perpendicular to the first axis.

In some embodiments according to this aspect of the present inventive subject matter, an edge of the hook element extends around an entire periphery of the attachment element, the periphery of the attachment element being substantially circular.

In some embodiments according to this aspect of the present inventive subject matter, a surface of the diffuser region is substantially circular.

In some embodiments according to this aspect of the present inventive subject matter, the attachment element comprises at least the nose element, a second nose element and a third nose element.

According to a sixth aspect of the present inventive subject matter, there is provided a light fixture, comprising:

a light engine housing, the light engine housing defining at least a first opening;

a diffuser;

at least a first attachment element; and at least one accessory, the diffuser comprising a diffuser region, the first attachment element comprising at least a first nose element, a hook element and a first connection region, the first connection region extending from the first nose element to the hook element, the first attachment element comprising a first peripheral edge;

the first nose element extending farther in a first direction than the first connection region extends in a second direction, the first direction being parallel to the second direction, the first direction and the second direction each being perpendicular to a first axis which passes through at least a portion of each of the first nose element and the first connection region, the first nose element being positioned on an opposite side of the first opening relative to the hook element, the first connection region extending through the first opening, at least a portion of the hook element extending farther in a third direction than the first connection region extends in the second direction, the third direction also being perpendicular to the first axis, at least a first surface of the diffuser being in contact with a first portion of the hook element, wherein if light passes through the diffuser region, the light would be diffused by passing through the diffuser region, the accessory comprising a second peripheral edge and at least a first spring element, the accessory being held in place relative to the diffuser by at least the first spring element, the accessory being of a shape such that if the accessory were not engaged with the diffuser, the first spring element would be in a first position in which it extends away from the second peripheral edge when no pressure is applied to the first spring element, wherein if the accessory is pushed toward the attachment element such that a first region surrounded by the first peripheral edge of the attachment element at least partially overlaps a second region surrounded by the second peripheral edge of the accessory, the first spring element would be pushed toward the second peripheral edge due to contact between a first surface of the first spring element with the hook element, and if the accessory is pushed further, the first spring element would reach a position relative to the hook element where the first spring element can move at least partially back toward the first position such that a second surface of the first spring element would come into contact with the hook element, whereby the accessory would be held in place relative to the attachment element due to at least contact between the second surface of the first spring element and the hook element.

In some embodiments according to this aspect of the present inventive subject matter, the first spring element is biased to extend inward from the second peripheral edge when no pressure is applied to the first spring element, wherein if the accessory is pushed toward the attachment element such that a first region surrounded by the first peripheral edge of the attachment element at least partially overlaps a second region surrounded by the second peripheral edge of the accessory, the first spring element would be pushed outward toward the second peripheral edge due to contact between the first surface of the first spring element with the hook element, and if the accessory is pushed further, the first spring element would reach a position where it is no longer pushed outward by contact with the hook element, and the first spring element would return toward the first position, such that the first spring element would extend inward from the second peripheral edge and a second surface of the first spring element would be in contact with the hook element, whereby the accessory would be held in place relative to the attachment element due to at least contact between the second surface of the first spring element and the hook element.

In some embodiments according to this aspect of the present inventive subject matter, the first spring element is biased to extend outward from the second peripheral edge when no pressure is applied to the first spring element, wherein if the accessory is pushed toward the attachment element such that the first peripheral edge of the attachment element passes through the second peripheral edge of the accessory, the first spring element would be pushed inward toward the second peripheral edge due to contact between the first surface of the first spring element with the hook element, and if the accessory is pushed further, the first spring element would reach a position where it is no longer pushed inward by contact with the hook element, and the first spring element would return toward the first position, such that the first spring element would extend outward from the second peripheral edge and a second surface of the first spring element would be in contact with the hook element, whereby the accessory would be held in place relative to the attachment element due to at least contact between the second surface of the first spring element and the hook element.

In some embodiments according to this aspect of the present inventive subject matter, the accessory is rotatable relative to the light engine housing.

In some embodiments according to this aspect of the present inventive subject matter, the first spring element comprises at least a third surface which is sloped such that the first spring element would be pushed gradually as the accessory is pushed toward the attachment element such that the first region surrounded by the first peripheral edge of the attachment element at least partially overlaps the second region surrounded by the second peripheral edge of the accessory.

In some embodiments according to this aspect of the present inventive subject matter, the accessory comprises at least the first spring element, a second spring element and a third spring element.

In some embodiments according to this aspect of the present inventive subject matter, a first plane defined by the first peripheral edge of the attachment element is substantially perpendicular to the first axis. In some such embodiments, the first peripheral edge of the attachment element is substantially circular.

According to a seventh aspect of the present inventive subject matter, there is provided an eyeball accessory for a light fixture, comprising:

a first eyeball housing element; and a second eyeball housing element, the first eyeball housing element having a first peripheral edge, the second eyeball housing element having a second peripheral edge, the second peripheral edge being positioned within the first eyeball housing element, at least a first portion of the first peripheral edge being pivotally attached to a second portion of the second eyeball housing element at a first location, whereby the second eyeball housing element is pivotable relative to the first eyeball housing element along a first line which passes through the first location, the first eyeball housing element having at least a first inner surface, the first eyeball housing element comprising at least a first surface irregularity on the first inner surface;

the second eyeball housing element having at least a first outer surface, the second eyeball housing element comprising at least a second surface irregularity on the first outer surface, the first surface irregularity being engageable with the second surface irregularity, wherein if the first surface irregularity is engaged with the second surface irregularity, the second eyeball housing element would be inhibited from pivoting relative to the first eyeball housing element.

In some embodiments according to this aspect of the present inventive subject matter, the first surface irregularity comprises a protrusion. In some such embodiments, the second surface irregularity comprises a recess.

In some embodiments according to this aspect of the present inventive subject matter, the first surface irregularity comprises a recess. In some such embodiments, the second surface irregularity comprises a protrusion.

In some embodiments according to this aspect of the present inventive subject matter, the first eyeball housing element comprises a plurality of surface irregularities on the first inner surface, whereby the second surface irregularity can be engaged with any of the plurality of surface irregularities on the first inner surface by orienting the second eyeball housing in any of a plurality of corresponding pivot positions relative to the first eyeball housing, and the second eyeball housing element would be inhibited from pivoting relative to the first eyeball housing element away from any of the rotational positions by engagement between the second surface irregularity and a corresponding one of the surface irregularities on the first inner surface. In some such embodiments, the plurality of surface irregularities on the first inner surface are aligned along a second line which is substantially perpendicular to the first line, whereby the second housing can be pivoted relative to the first housing and moved among the pivot positions in a ratcheting motion.

In some embodiments according to this aspect of the present inventive subject matter, the second eyeball housing element comprises a plurality of surface irregularities on the first outer surface, whereby the first surface irregularity can be engaged with any of the plurality of surface irregularities on the first outer surface by orienting the second eyeball housing in any of a plurality of corresponding pivot positions relative to the first eyeball housing, and the second eyeball housing element would be inhibited from rotating relative to the first eyeball housing element away from any of the pivot positions due to engagement between the first surface irregularity and a corresponding one of the surface irregularities on the first outer surface. In some such embodiments, the plurality of surface irregularities on the first outer surface are aligned along a third line which is substantially perpendicular to the first line, whereby the second housing can be pivoted relative to the first housing and moved among the pivot positions in a ratcheting motion.

In some embodiments according to this aspect of the present inventive subject matter, the eyeball accessory further comprises at least a first reflector positioned on an inside surface of the first eyeball housing element and a second reflector positioned on an inside surface of the second eyeball housing element.

In some embodiments according to this aspect of the present inventive subject matter, the eyeball accessory further comprises an eyeball accessory diffuser positioned within a peripheral interior surface of the first eyeball housing element or the second eyeball housing element, the eyeball accessory diffuser having a peripheral external edge, the eyeball accessory diffuser comprising at least one diffuser retention member extending from the peripheral external edge, the diffuser retention member being in contact with at least one diffuser contact member extending from the peripheral interior surface of the first eyeball housing element or the second eyeball housing element. In some such embodiments, the diffuser contact member comprises at least two holding members positioned on opposite sides of the diffuser retention member, the holding members inhibiting the eyeball accessory diffuser from rotating relative to the first eyeball housing element or the second eyeball housing element about an axis of the eyeball accessory diffuser.

According to an eighth aspect of the present inventive subject matter, there is provided an eyeball accessory for a light fixture, comprising:

a first eyeball housing element; and a second eyeball housing element, the first eyeball housing element having a first peripheral edge, the second eyeball housing element having a second peripheral edge, the second peripheral edge being positioned within the first eyeball housing element, the first eyeball housing element having at least a first inner surface, the first eyeball housing element comprising at least a first surface irregularity on the first inner surface;

the second eyeball housing element having at least a first outer surface, the second eyeball housing element comprising at least a second surface irregularity on the first outer surface, wherein the eyeball accessory can be oriented such that the second surface irregularity engages the first surface irregularity, the second eyeball housing element being pivotable relative to the first eyeball housing element in a direction along a first line which passes through the first surface irregularity.

In some embodiments according to this aspect of the present inventive subject matter, the first surface irregularity comprises a protrusion. In some such embodiments, the second surface irregularity comprises a recess.

In some embodiments according to this aspect of the present inventive subject matter, the first surface irregularity comprises a recess. In some such embodiments, the second surface irregularity comprises a protrusion.

In some embodiments according to this aspect of the present inventive subject matter, the eyeball accessory can be oriented such that the second surface irregularity is pressed against the first surface irregularity by gravitational force and the second eyeball housing element is pivotable relative to the first eyeball housing element along a first line which passes through the first surface irregularity.

In some embodiments according to this aspect of the present inventive subject matter, the first peripheral edge and the second peripheral edge are each substantially circular, and the first line extends tangentially relative to the second peripheral edge.

In some embodiments according to this aspect of the present inventive subject matter, the first inner surface of the first eyeball housing element has a first complementary surface structure and the first outer surface of the second eyeball housing element has a second complementary surface structure, the first complementary surface structure and the second complementary surface structure staying in contact and sliding relative to one another if the second eyeball housing element is rotated relative to the first eyeball housing element along the first line. In some such embodiments: at least a portion of the first inner surface is substantially in a shape of a partial cylinder, the first complementary surface comprises a first contour surface which extends from the first inner surface to a larger extent in a first region than in a second region, the first region being closer to the first peripheral edge than the second region, and the second complementary surface comprises a second contour surface which is rounded, whereby if the second eyeball housing element is rotated relative to the first eyeball housing element along the first line, different portions of the rounded second contour surface would come into contact with the first contour surface. In some of these embodiments, the second contour surface is substantially in a shape of an oblong cylinder In some embodiments according to this aspect of the present inventive subject matter, the eyeball accessory further comprises at least a first reflector positioned on an inside surface of the first eyeball housing element and a second reflector positioned on an inside surface of the second eyeball housing element.

In some embodiments according to this aspect of the present inventive subject matter, the eyeball accessory further comprises an eyeball accessory diffuser positioned within a peripheral interior surface of the first eyeball housing element or the second eyeball housing element, the eyeball accessory diffuser having a peripheral external edge, the eyeball accessory diffuser comprising at least one diffuser retention member extending from the peripheral external edge, the diffuser retention member being in contact with at least one diffuser contact member extending from the peripheral interior surface of the first eyeball housing element or the second eyeball housing element. In some such embodiments, the diffuser contact member comprises at least two holding members positioned on opposite sides of the diffuser retention member, the holding members inhibiting the eyeball accessory diffuser from rotating relative to the first eyeball housing element or the second eyeball housing element about an axis of the eyeball accessory diffuser.

According to a ninth aspect of the present inventive subject matter, there is provided an accessory for a light fixture, the accessory comprising:

at least a first housing member, the first housing member having an accessory peripheral edge and at least a first spring element, the first spring element being biased to a rest position where a portion of the first spring element extends away from the accessory peripheral edge when no pressure is applied to the first spring element, the accessory peripheral edge defining an internal area, wherein if a force is applied to the first spring element to push the first spring element outward toward the accessory peripheral edge, and if the force were then removed, the first spring element would flex back toward the rest position.

In some embodiments according to this aspect of the present inventive subject matter, the first spring element is biased to a rest position where a portion of the first spring element extends inward from the accessory peripheral edge when no pressure is applied to the first spring element, wherein if a force is applied to the first spring element to push the first spring element outward relative to the internal area, the first spring element would flex outward toward the accessory peripheral edge, and if the force were removed, the first spring element would flex back toward the rest position.

In some embodiments according to this aspect of the present inventive subject matter, the first spring element is biased to a rest position where a portion of the first spring element extends outward from the accessory peripheral edge when no pressure is applied to the first spring element, wherein if a force is applied to the first spring element to push the first spring element inward relative to the internal area, the first spring element would flex inward toward the accessory peripheral edge, and if the force were removed, the first spring element would flex back toward the rest position.

In some embodiments according to this aspect of the present inventive subject matter, the accessory peripheral edge is in a shape of a circle with at least one gap.

In some embodiments according to this aspect of the present inventive subject matter, the accessory comprises at least the first spring element, a second spring element and a third spring element.

According to a tenth aspect of the present inventive subject matter, there is provided an accessory for a light fixture, the accessory comprising:

at least a first housing member, the first housing member having an accessory peripheral edge and at least a first spring element, the accessory peripheral edge being in a shape of a circle with at least one gap, the first spring element being in a first position in which it extends away from the accessory peripheral edge when no pressure is applied to the first spring element, the accessory peripheral edge defining an internal area, wherein if:

(1) the accessory is pushed toward a light fixture which comprises a fixture peripheral edge comprising at least a first substantially circular region and a second substantially circular region, the first substantially circular region having a diameter such that it would fit snugly with the accessory peripheral edge, the second substantially circular region having a diameter which differs from a diameter of the first substantially circular region, and the first substantially circular region comprising an axis which is substantially coaxial with an axis of the second substantially circular region, and (2) while the accessory is being pushed toward the light fixture, an axis of the accessory peripheral edge remains substantially coaxial with the axis of the first substantially circular region, and the accessory peripheral edge first becomes concentric with the first substantially circular region and then with the second substantially circular region, the first spring element would be pushed toward the accessory peripheral edge due to contact between a first surface of the first spring element with the first substantially circular region, and then the first spring element would reach a position relative to the first substantially circular region where the first spring element can move at least partially back toward the first position, such that (1) the first spring element would extend away from the accessory peripheral edge, and (2) a second surface of the first spring element would be in contact with the first substantially circular region, whereby the accessory would be held in place relative to the light fixture due to at least contact between the second surface of the first spring element and the first substantially circular region.

In some embodiments according to this aspect of the present inventive subject matter, the first spring element is biased to extend inward from the accessory peripheral edge when no pressure is applied to the first spring element.

In some embodiments according to this aspect of the present inventive subject matter, the first spring element is biased to extend outward from the accessory peripheral edge when no pressure is applied to the first spring element.

In some embodiments according to this aspect of the present inventive subject matter, the first spring element comprises at least a third surface which is sloped such that the first spring element would be pushed outward gradually as the accessory is pushed toward the light fixture such that the fixture peripheral edge would pass through the first substantially circular region of the accessory.

In some embodiments according to this aspect of the present inventive subject matter, the accessory comprises at least the first spring element, a second spring element and a third spring element.

The present inventive subject matter thus provides devices which allow the manufacturer's SKU count to stay low by "retrofitting" any standard recessed downlight into an eyeball fixture after initial installation. This same flexibility also allows for faster installation (by not requiring the contractor to differentiate between fixture types as he is installing) and increased consumer flexibility (by allowing the homeowner or user to move the "eyeball" accessories to whichever fixtures they deem appropriate, rather than having fixed installations.) Additionally, the accessory provides a method to "hide" some or all of its structure in the recess between the ceiling plane and the downlight diffuser, making it less obtrusive and more attractive. Furthermore, by using integral "kicker" reflectors made from highly reflective anodized aluminum (or metallized aluminum, or steel, or plastic with a vacuum metallized finish), and incorporating a purpose-designed diffusing, diffractive or Fresnel lens, the eyeball accessory wastes less light, giving a lower penalty to fixture efficacy than would otherwise be incurred by a traditional solution. Lastly, the devices according to the present inventive subject matter provide the ability to add different aesthetic treatments to a base white fixture, without the expense and difficulty of having to provide several to dozens of different finishes and textures on the fixture itself. Different optical profiles, finishes, and textures can be created in a trim accessory which snaps into the base fixture in a similar way (and using the same diffuser structure) as the eyeball accessory.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTION(S)

Figure 1:
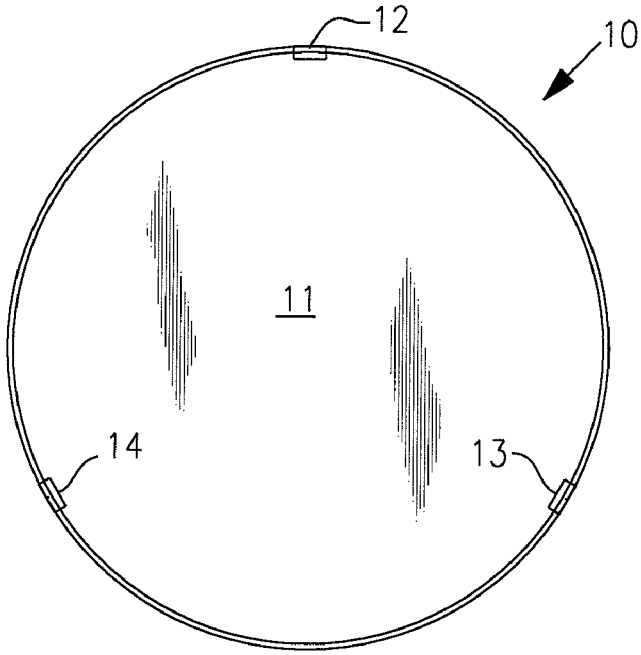
FIG. 1 is a top view of a diffuser according to a first embodiment of the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The present inventive subject matter relates to methods for retaining an "eyeball" accessory into the LLF downlight, as well as accessory retaining structures suitable for retaining multiple different kinds of accessories, and combinations thereof. The inventive subject matter includes embodiments which are integrated directly with the diffuser.

A specific problem addressed by the present inventive subject matter is the need to retain a user installed "eyeball" accessory in a downlight without disrupting the aesthetics of the unit or adding high cost features to the lower housing which significantly reduced external fin area.

The present inventive subject matter is applicable to a wide variety of lighting devices, including, for example, recessed can lighting fixtures based with a lens, using LED or conventional light sources.

Residential recessed downlights are generally made in multiple configurations for a variety of uses. White baffle downlights are the most common, used in general in living areas and kitchens. A version which allows for the recessed downlight's light to be directed more towards a wall from a ceiling mounted position is often referred to as an "eyeball", due to the spherical shape of the protruding reflector used to redirect the light.

Generally, these configurations of recessed downlights (standard white baffle or reflector vs. eyeball) are specifically selected at the point of purchase by the contractor or consumer. This is to say, an eyeball fixture may not be adapted for use as a white baffle downlight, or a white baffle downlight adapted for use as an eyeball. In an effort to provide maximum flexibility to the consumer and minimize the number of SKUs necessary to meet market demand, it is advantageous to provide a general fixture with a white baffle that can be adapted via use of an accessory into an eyeball.

By the use of an accessory, it can be seen that SKU count is reduced by making the eyeball non-specific. For example, rather than a warm white, cool white and commercial white standard fixture, as well as these same variations for an eyeball fixture (creating a total of six SKUs), all that is required are the three standard fixtures plus one accessory (i.e., a total of only four SKUs). This example is applicable to any variations provided to the consuming market currently or in the future.

It can also be seen that this configuration provides maximum flexibility to the consumer, especially when one considers the general application of accessories for optical or aesthetic modification. Now the consumer may install a single type of base fixture (warm white) in all locations, and then accessorize each location per taste and easily change accessory locations and types after construction and installation. In such a way, an installer or consumer could try eyeballs, reflector trims or glass ring accessories in different locations to gauge the aesthetic and optical impact of each.

The present inventive subject matter is unique at least in the sense that it does not require disassembly and reinstallation of the entire fixture to add and remove accessories (or in the case of prior fixture designs, changing complete fixture configuration.) At the same time, the locations within the fixture to attach these accessories are unobtrusive even when no accessories are installed. Lastly, both alternatives provide a method specifically for retaining a diffuser or lens in front of the lamp or LEDs.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, the term "substantially," e.g., in the expressions "substantially circular", "substantially level", "substantially parallel", "substantially perpendicular", "substantially cylindrical", "substantially coaxial", etc., means at least about 90% correspondence with the feature recited, e.g.,

- the expression "substantially circular" means that a circle can be drawn having the formula $x^2+y^2=1$, where imaginary axes can be drawn at a location where the y coordinate of each point on the structure is within 0.90 to 1.10 times the value obtained by inserting the x coordinate of such point into such formula;
- the expression "substantially level" means that at least 90% of the points in the surface which is characterized as being substantially level are located on one of or between a pair of planes which are level and which are spaced from each other by a distance of not more than 10% of the largest dimension of the surface;
- the expression "substantially parallel" means that two lines (or two planes) diverge from each other at most by an angle of 10% of 90 degrees, i.e., 9 degrees;
- the expression "substantially perpendicular", as used herein, means that at least 90% of the points in the structure which is characterized as being substantially perpendicular to a reference plane or line are located on one of or between a pair of planes (1) which are perpendicular to the reference plane, (2) which are parallel to each other and (3) which are spaced from each other by a distance of not more than 10% of the largest dimension of the structure;
- the expression "substantially cylindrical" (and analogous statements), as used herein, means that at least 90% of the points in the surface which is characterized as being substantially cylindrical are located on one of or between a pair of imaginary cylindrical structures which are spaced from each other by a distance of not more than 10% of their largest dimension; and
- the expression "substantially coaxial" means that the axes of the respective surfaces come to within a distance of not more than 10% of the largest dimension of the respective surfaces, and that the respective axes define an angle of not greater than 10 degrees.

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in various aspects according to the present inventive subject matter, there is provided a diffuser comprising a diffuser region, a hook element, one or more nose elements, two or more connection regions, and/or an attachment element.

The diffuser region can be made of any material or materials used to diffuse light. A wide variety of such materials are well-known to those skilled in the art, and any such materials can be employed according to the present inventive subject matter.

The nose element(s), the hook element(s), the connection region(s) and/or the attachment element(s) can be made of any desired material, a wide variety of which will be readily apparent to those skilled in the art, any of which can be employed according to the present inventive subject matter. In embodiments which include a diffuser region, the nose element(s), the hook element(s) and/or the connection region (s) can be made of the same material as the diffuser region, or of one or more materials which are different from the diffuser region.

As noted above, in various aspects according to the present inventive subject matter, there is provided a light fixture comprising a light engine housing. Persons of skill in the art are familiar with a wide variety of light fixtures, and any such light fixture can be employed according to the present inventive subject matter. The light engine housing can be made of any material or materials suitable for use in making a light engine housing for a light fixture. A wide variety of such materials are well-known to those skilled in the art, and any such materials can be employed according to the present inventive subject matter. A representative example of a suitable material is ABS thermoplastic material.

As noted above, various aspects according to the present inventive subject matter include one or more light fixture accessories. Persons of skill in the art are familiar with a wide variety of light fixture accessories, and the present inventive subject matter can employ and/or be able to accommodate all of such accessories. Representative examples of such accessories include eyeball accessories, color filter accessories, trim accessories (which can be any desired color, texture and/or surface shape, and made of any desired material, e.g., spun aluminum), baffles (e.g., cross baffles, made of formed anodized aluminum sheet (like what is conventionally used in "parabolic" linear fluorescent fixtures common in office spaces), plexiglass or other suitable material, e.g., to avoid subjecting room occupants to direct light, or edge-lit baffles (made of any suitable desired material, e.g., clear or tinted acrylic (PMMA) sheet, cast or injection molded acrylic, etc.), decorative accessories (e.g., plexiglass), etc. The accessories, and their various components, can be made of any material or materials suitable for use in making such accessories and components and/or for providing the respective functions described herein. A wide variety of such materials are well-known to those skilled in the art, and any such materials can be employed according to the present inventive subject matter. Representative examples of materials which are suitable for making accessories include, among a wide variety of other materials, spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 2:
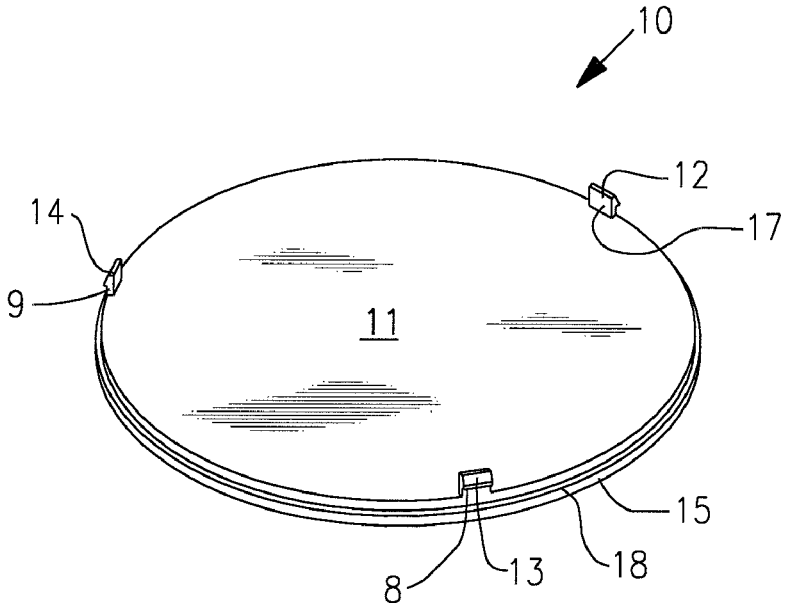
FIG. 2 is a perspective view of the diffuser shown in FIG. 1.
Figure 3:
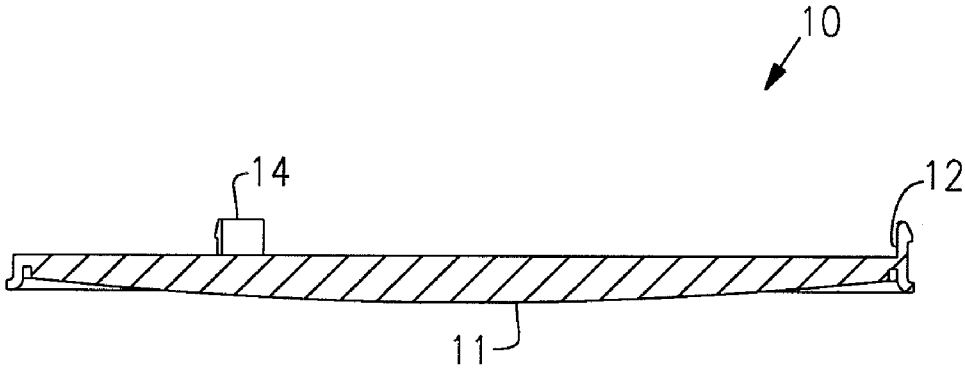
FIG. 3 is a sectional view of the diffuser shown in FIG. 1.
Figure 4:
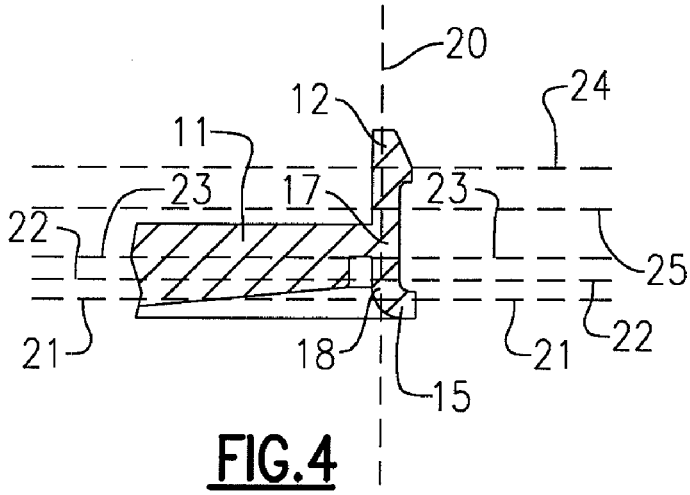
FIG. 4 is a partial view of the view shown in FIG. 3.

FIGS. 1-4 depict a first embodiment of a diffuser for a lighting device according to the present inventive subject matter. FIG. 1 is a top view of the diffuser, FIG. 2 is a perspective view of the diffuser, FIG. 3 is a sectional view of the diffuser, and FIG. 4 is a partial view of the view shown in FIG. 3.

Referring to FIGS. 2 and 3, the diffuser 10 comprises a diffuser region 11, a first nose element 12, a second nose element 13, a third nose element 14, a first connection region 17 (extending from the diffuser region 11 to the first nose element 12), a circumferential hook element 15, a second connection region 18 (extending circumferentially from the diffuser region 11 to the hook element 15), as well as additional connection regions 8, 9 extending from the diffuser region 11 to the second nose element 13 and the third nose element 14, respectively.

Referring to FIG. 4, the first nose element 12 extends from a first connection region 17. As can be seen in FIG. 4, the widest part of the first nose element 12 extends farther in a first direction (along dotted line 24 which extends perpendicular to a first axis 20, the first axis 20 passing through a portion of the first nose element 12 and a portion of the first connection region 17) than the first connection region 17 extends in a second direction (parallel to the first direction, along dotted line 25 which also extends perpendicular to the first axis 20).

As can also be seen in FIG. 4, the circumferential hook element 15 extends from the circumferential second connection region 18. A portion of the hook element 15 extends farther in a third direction (along dotted line 21 which extends perpendicular to the first axis 20) than the second connection region 18 extends in a fourth direction (parallel to the third direction, along dotted line 22 which also extends perpendicular to the first axis 20).

Alternatively, one or more of the connection regions could be eliminated, and the nose element(s) and/or the hook element could extend farther in their respective first or third directions than the diffuser region extends in its second or fourth respective directions.

In the embodiment shown in FIG. 4, the hook element extends around the entire periphery of the diffuser. Alternatively, in this embodiment and others, the hook element can extend around only a portion or portions of the periphery.

Referring to FIG. 4, a major dimension of the diffuser region 11 extends in a plane 23 which is also perpendicular to the axis 20.

As can be seen in FIG. 1, a surface of the diffuser region 11 is substantially circular.

Figure 5:
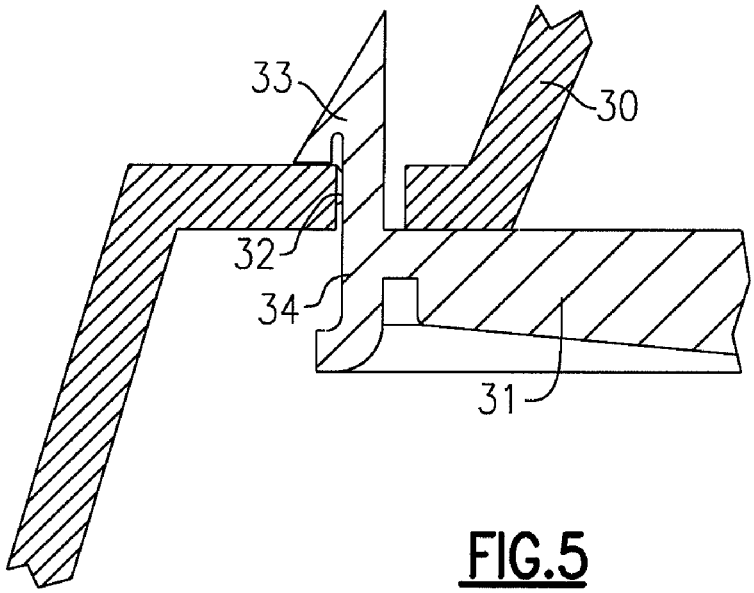
FIG. 5 depicts a first embodiment of a light fixture according to the present inventive subject matter.

FIG. 5 depicts a portion of a first embodiment of a light fixture according to the present inventive subject matter. Referring to FIG. 5, there is shown a light engine housing 30 and a diffuser 31. The light engine housing 30 defines a first opening 32. The diffuser 31 is similar to the diffuser 10 depicted in FIGS. 1-4. As shown in FIG. 5, a nose element 33 of the diffuser 31 is positioned on an opposite side of the first opening 32 relative to a circumferential hook element 35, a first connection region 34 extending through the opening 32. Two other nose elements of the diffuser, not visible in FIG. 5, are located at positions along a circular peripheral edge of the diffuser 31 such that the three nose elements are spaced evenly around the peripheral edge of the diffuser 31, and each of the other two nose elements are positioned on opposite sides (relative to the hook element 35) of second and third openings, respectively, in the light engine housing 30, relative to the hook element 35.

Figure 6:
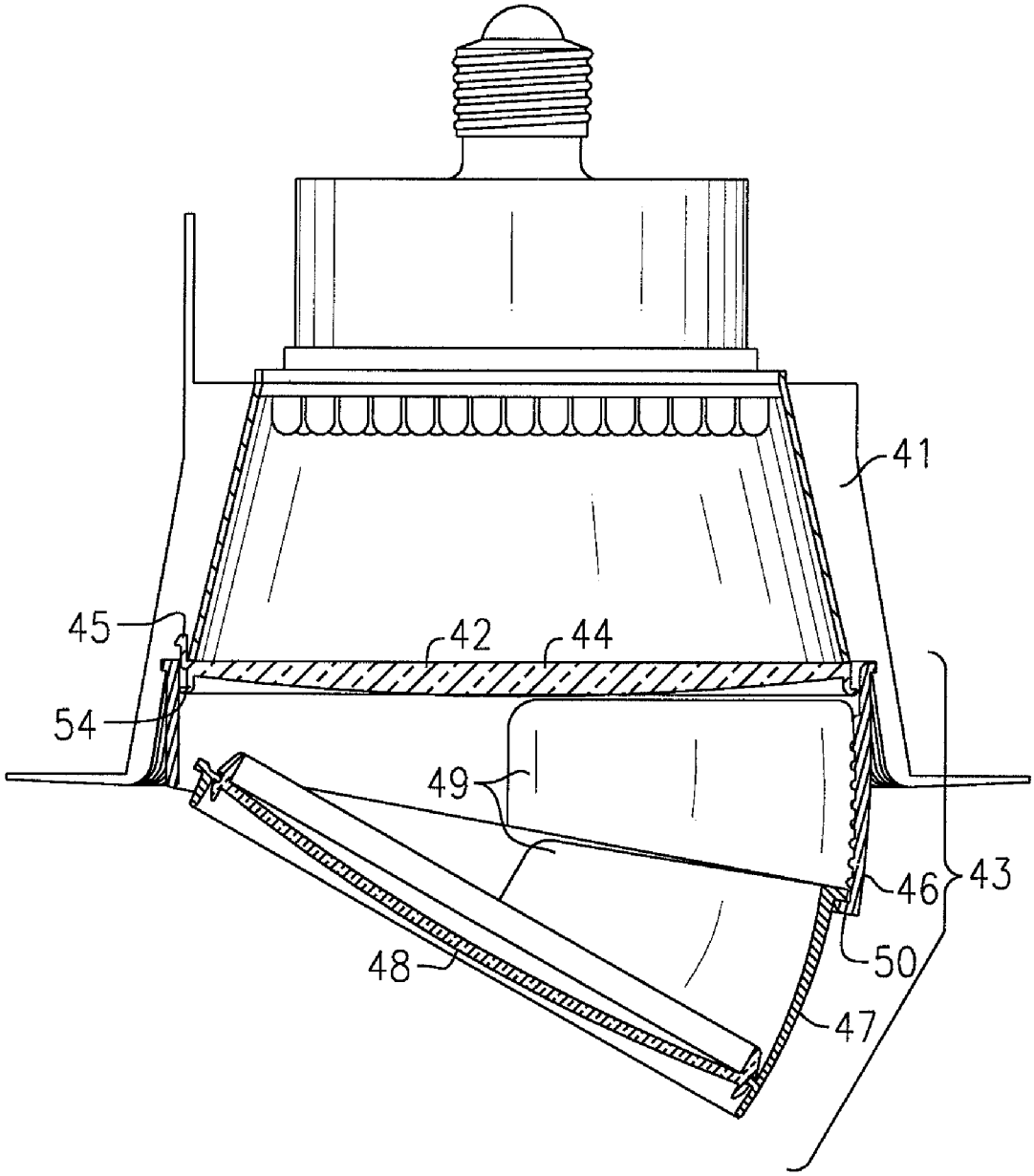
FIG. 6 depicts a second embodiment of a light fixture according to the present inventive subject matter.

FIG. 6 depicts a second embodiment of a light fixture according to the present inventive subject matter. The embodiment depicted in FIG. 6 comprises a light engine housing 41, a diffuser 42 and an accessory 43 (in this instance, an eyeball accessory). The diffuser comprises a diffuser region 44, a first nose element 45, a second nose element (not visible in FIG. 6), a third nose element (not visible in FIG. 6) and a circumferential hook element 54. The respective connection regions for the nose elements extend through openings in the light engine housing 41, thereby securing the nose elements in place. The hook element 54 engages spring elements which are biased inward from a peripheral edge of the accessory 43 in a manner as in the embodiment depicted in FIG. 10 and discussed below. In its most recessed configuration, the eyeball itself only protrudes approximately 1" below the ceiling plane. The accessory 43 includes an upper eyeball housing 46, a lower eyeball housing 47, an eyeball diffuser 48, a pair of reflectors (made of any suitable material, e.g., anodized aluminum, metallized aluminum, or steel) 49, and seal 50 (made of any suitable material, e.g., a soft-durometer thermoplastic elastomer (TPE) or similar material, e.g., Santoprene®), which can be attached to either housing 46 or 47 (and which, in this embodiment, is attached to the upper housing 46). In the embodiments shown in FIGS. 6 and 7, a peripheral edge of the lower eyeball housing (47 in FIG. 6) is positioned inside the upper eyeball housing (46 in FIG. 6)—alternatively, a peripheral edge of the upper eyeball housing could be positioned inside the lower eyeball housing. The eyeball diffuser 48 can assist in hiding mechanics within the accessory (such mechanics can include any of a wide variety of structure, e.g., a sensor to detect one or more color output in order to adjust one or more light emitters to maintain or control a desired overall color output). Even where a diffuser is used in the eyeball (or other accessory), it is sometimes advantageous to also employ a diffuser in the light engine housing, e.g., to avoid a situation where the reflectors would otherwise "see" the light emitters (e.g., LEDs) and thereby avoid bright spots. In some instances, it is advantageous to facet the reflector (or one or more of the reflectors) in order to avoid the appearance of "dots", a phenomenon known to those of skill in the art. In addition, any surface of the lighting devices can include a reflective layer (e.g., formed of MCPET®, a material marketed by Furukawa, a Japanese corporation), although in the case of an eyeball accessory, it is typically desirable to use reflectors in order to direct the light toward the exit (e.g., through an accessory diffuser).

Figure 7:
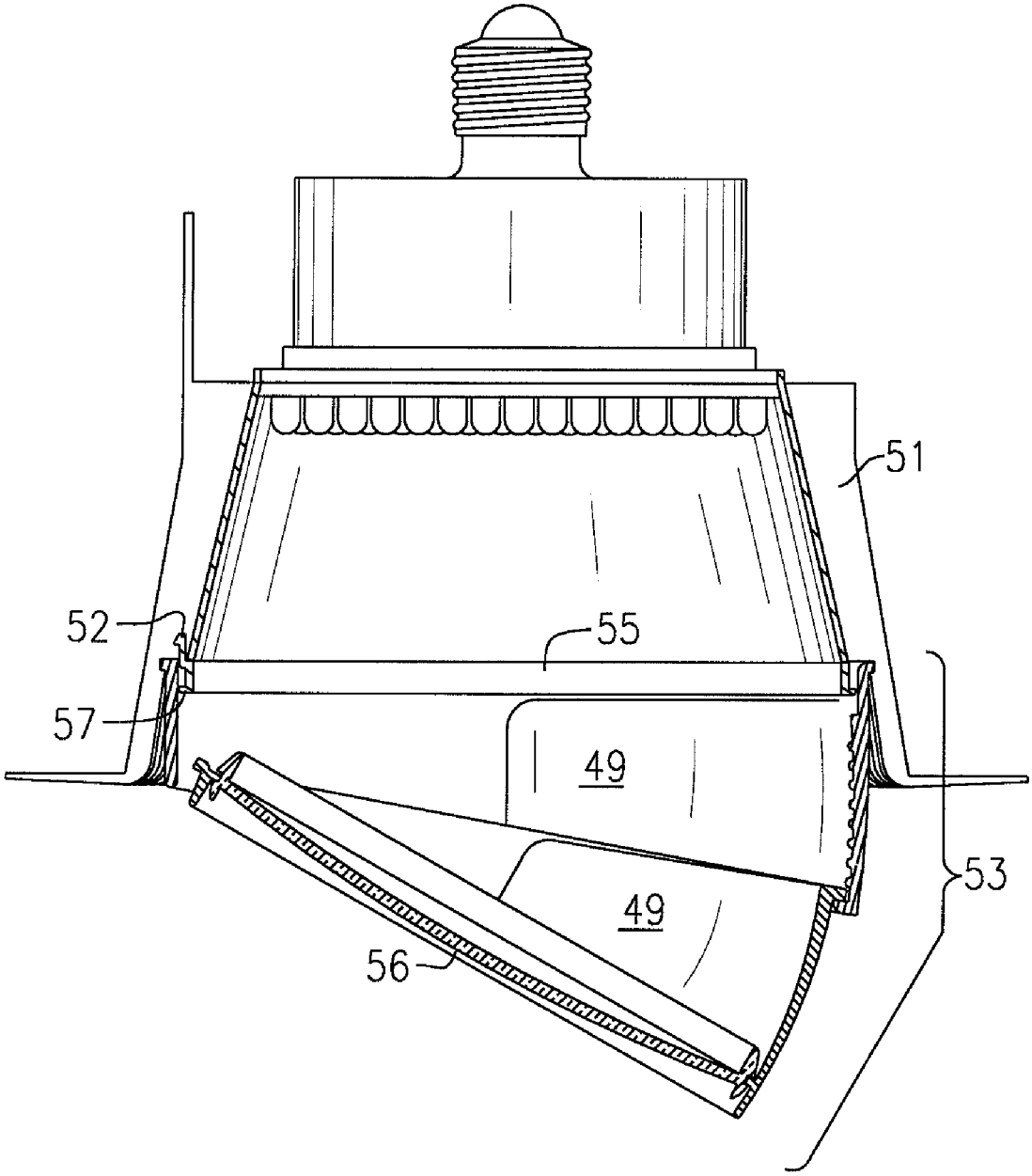
FIG. 7 depicts a third embodiment of a light fixture according to the present inventive subject matter.

FIG. 7 depicts a third embodiment of a light fixture according to the present inventive subject matter. The embodiment depicted in FIG. 7 comprises a light engine housing 51, an attachment element 55 and an accessory 53 (in this instance, an eyeball accessory which includes a diffuser 56). The attachment element 55 comprises a first nose element 52, a second nose element (not visible in FIG. 7), a third nose element (not visible in FIG. 7) and a hook element 57. The nose elements extend through respective openings in the light engine housing, thereby securing the nose elements in place. The hook element 57 engages spring elements which are biased inward from a peripheral edge of the accessory 53 in a manner as in the embodiment depicted in FIG. 10 and discussed below. The embodiment depicted in FIG. 7 differs from the embodiment depicted in FIG. 6 in that the embodiment depicted in FIG. 7 does not include a diffuser in the light engine housing.

Figure 8:
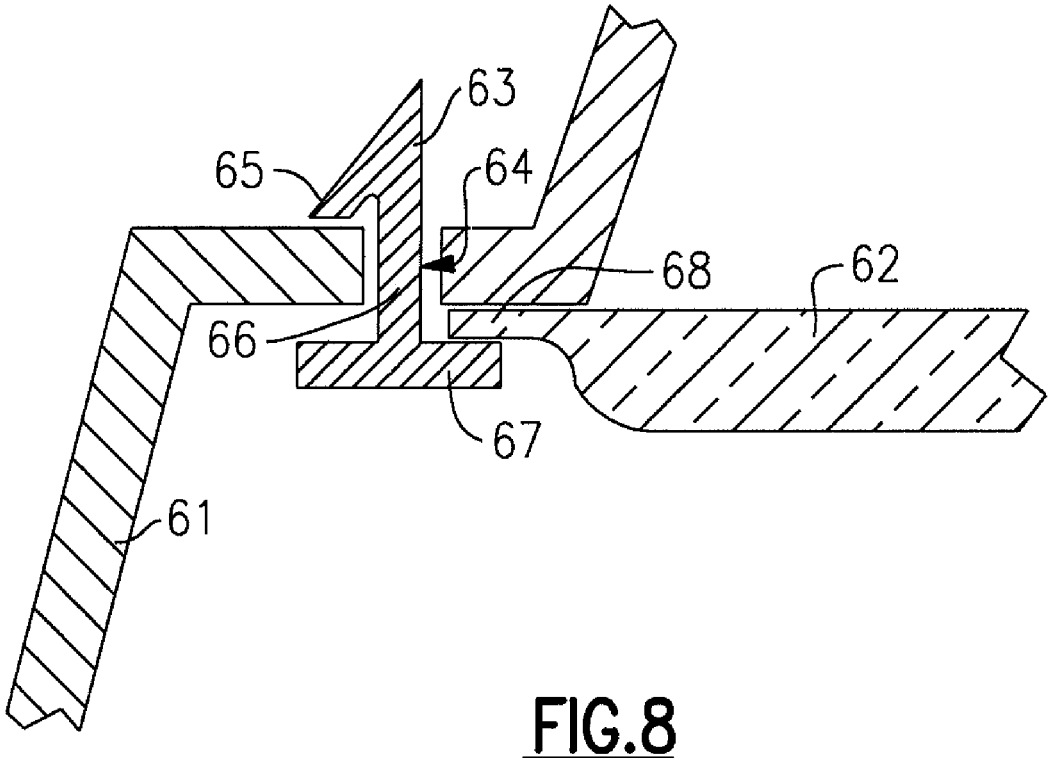
FIG. 8 depicts a fourth embodiment of a light fixture according to the present inventive subject matter.

FIG. 8 depicts a fourth embodiment of a light fixture according to the present inventive subject matter. Referring to FIG. 8, there is shown a light engine housing 61, a diffuser 62 and an attachment element 63. The attachment element 63 includes a circumferential hook element 67, a first nose element 65, a second nose element (not visible in FIG. 8), a third nose element (not visible in FIG. 8), a first connection region 66 connecting the first nose element 65 to the hook element 67, a second connection region (not visible in FIG. 8) connecting the second nose element to the hook element 67, and a third connection region (not visible in FIG. 8) connecting the third nose element to the hook element 67. The light engine housing 61 defines a first opening 64. As shown in FIG. 8, the first nose element 65 is positioned on an opposite side of the first opening 64 relative to the hook element 67, the connection region 66 extending through the opening. The two other nose elements, not visible in FIG. 8, are located at positions adjacent to the circular peripheral edge of the diffuser 62 such that the three nose elements are spaced evenly around the peripheral edge of the diffuser 62, and each of the other two nose elements are positioned on opposite sides of second and third openings, respectively, in the light engine housing 61, relative to the hook element 67. The hook element 67 extends in both radial directions (i.e., outward to the left and inward to the right as shown in FIG. 8). A protrusion 68 located on the peripheral edge of the diffuser 62 rests on the inwardly extending peripheral portion of the hook element 67.

Figure 9:
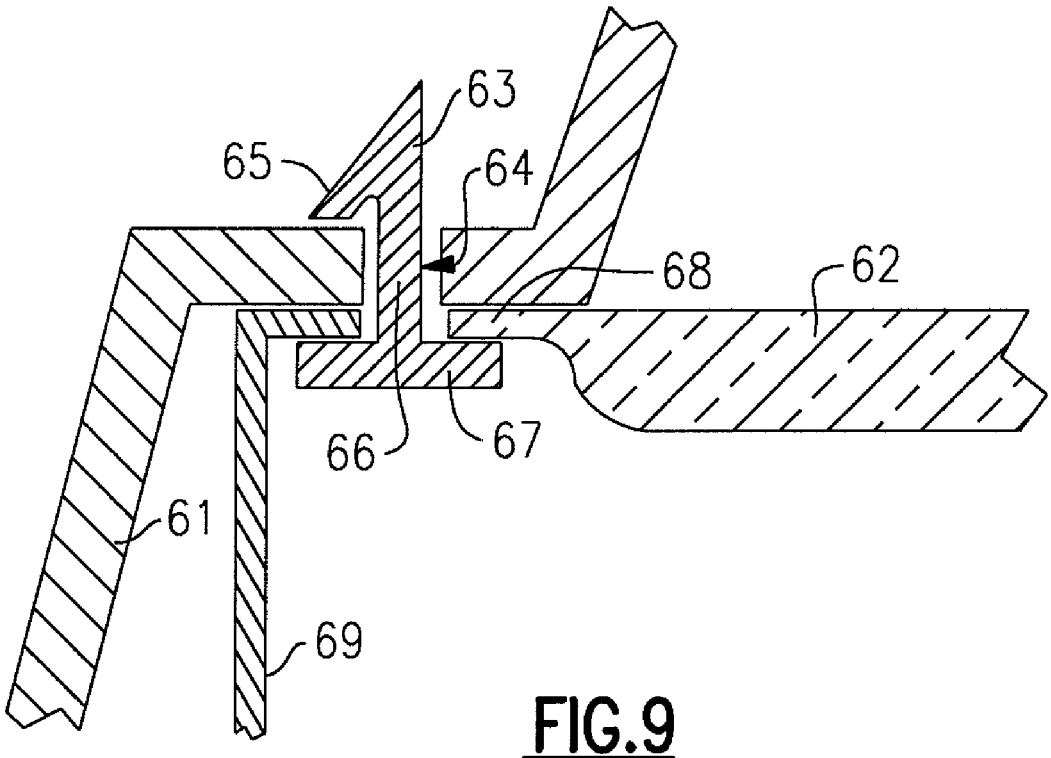
FIG. 9 depicts a fifth embodiment of a light fixture according to the present inventive subject matter.

FIG. 9 depicts a fifth embodiment of a light fixture according to the present inventive subject matter. The embodiment depicted in FIG. 9 is similar to the embodiment depicted in FIG. 8, except that the embodiment depicted in FIG. 9 further includes an accessory 69. The outwardly extending peripheral portion of the hook element 67 engages spring elements which are biased inward from a peripheral edge of the accessory 69 in a manner as in the embodiment depicted in FIG. 10 and discussed below.

Figure 10:
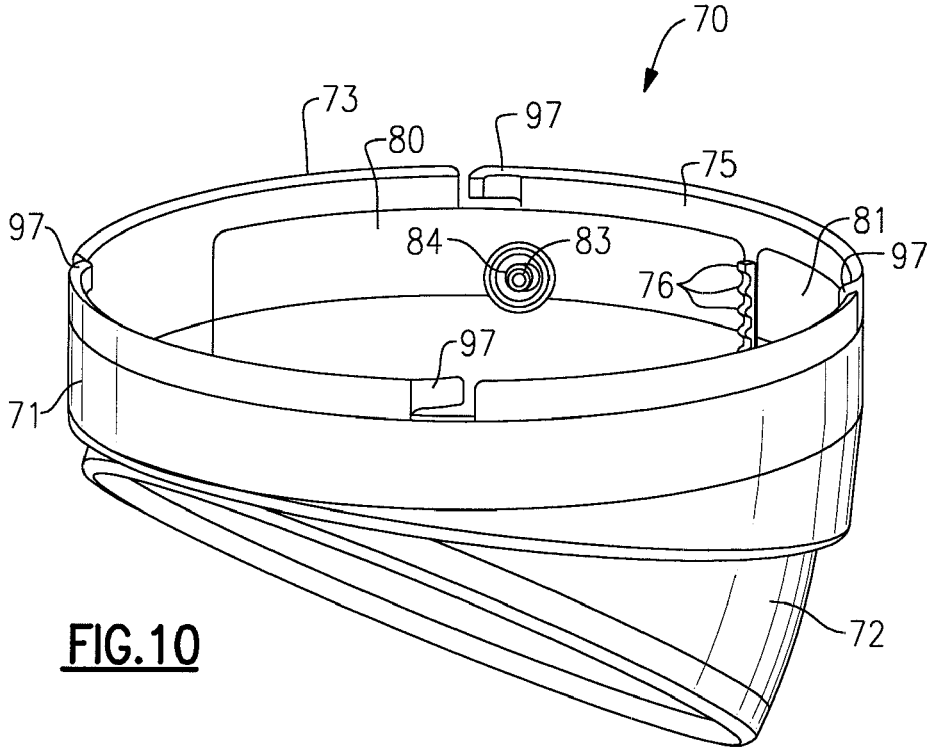
FIG. 10 depicts a first embodiment of an eyeball accessory for a light fixture according to the present inventive subject matter.
Figure 11:
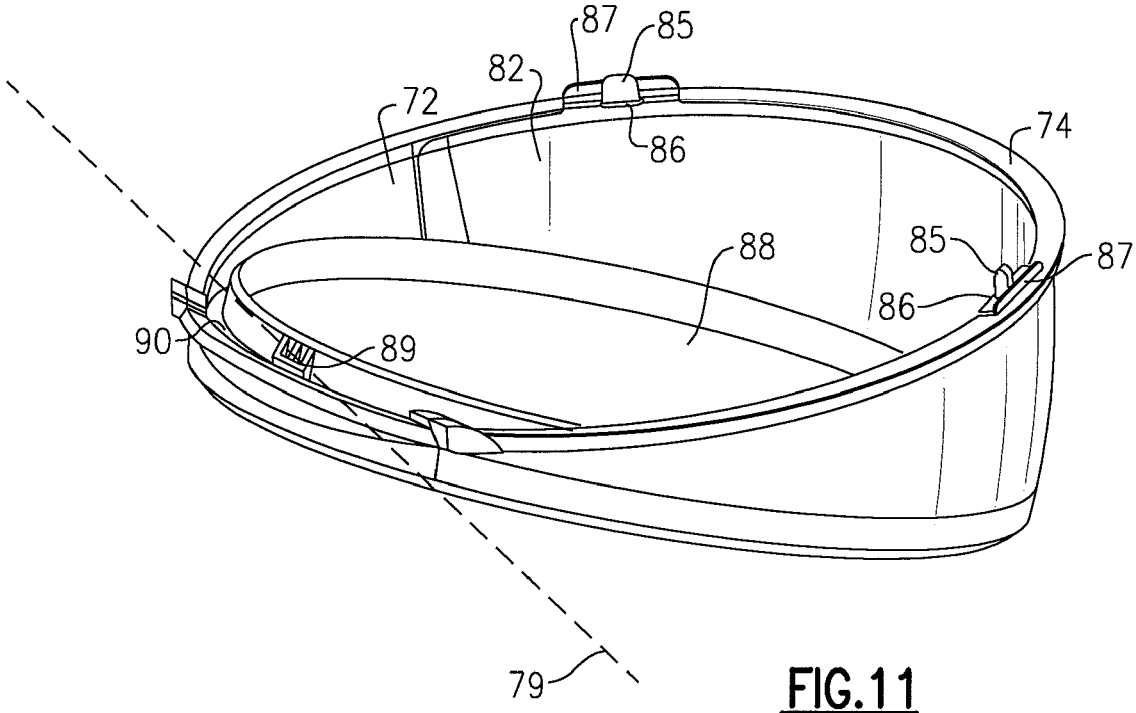
FIG. 11 depicts the second eyeball housing element of the embodiment depicted in FIG. 10.
Figure 12:
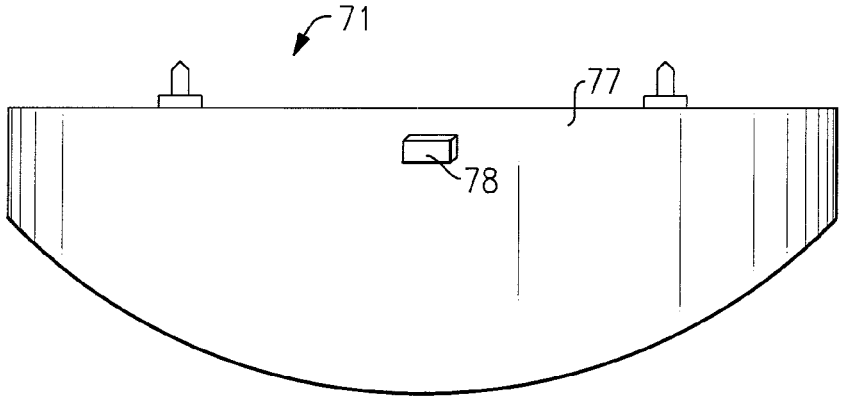
FIG. 12 depicts an outer surface of the second eyeball housing element in the embodiment depicted in FIGS. 10 and 11.

FIG. 10 depicts a first embodiment of an eyeball accessory for a light fixture according to the present inventive subject matter. Referring to FIG. 10, there is shown an eyeball accessory 70 comprising a first eyeball housing element 71 and a second eyeball housing element 72. FIG. 11 depicts the second eyeball housing element 72 separate from the first eyeball housing element 71. The first eyeball housing element 71 has a first peripheral edge 73 and the second eyeball housing element 72 has a second peripheral edge 74 (see FIG. 11). As shown in FIG. 10, the second peripheral edge 74 is positioned within the first eyeball housing element 71. As discussed below, the second eyeball housing element 72 is pivotable relative to the first eyeball housing element 71 about a first line 79 (see FIG. 11). The first eyeball housing element 71 has an inner surface 75 which comprises a plurality of surface irregularities 76 (in the form of protrusions). FIG. 12 depicts an outer surface 77 of the second eyeball housing element 72. Referring to FIG. 12, the outer surface 77 of the second eyeball housing element 72 has a surface irregularity 78 (in the form of a protrusion). The surface irregularity 78 on the outer surface of the second eyeball housing element 72 is engageable with each of the surface irregularities 76 on the inner surface of the first eyeball housing element 71, wherein if the surface irregularity 78 is engaged with any of the irregularities 76, the second eyeball housing element 72 is inhibited from pivoting relative to the first eyeball housing element 71 about the first line 79. Thus, the second eyeball housing element surface irregularity 78 can be engaged with any of the plurality of surface irregularities 76 on the inner surface 75 of the first eyeball housing element 71 by orienting the second eyeball housing element 72 in any of a plurality of corresponding pivot positions relative to the first eyeball housing element 71, whereby the second eyeball housing element 72 is inhibited from pivoting relative to the first eyeball housing element 71 away from any of the pivot positions due to the engagement between the surface irregularity 78 and a corresponding one of the surface irregularities 76. As shown in FIG. 10, the plurality of surface irregularities 76 on the inner surface of the first eyeball housing element 71 are aligned along a line which is substantially perpendicular to the first line 79, whereby the second eyeball housing element 72 can be rotated relative to the first eyeball housing element 71 and moved among the rotational positions in a ratcheting motion.

As also shown in FIGS. 10 and 11, the eyeball accessory 70 further comprises a first reflector 80 and a second reflector 81 each positioned on the inside surface of the first eyeball housing element 71, and a third reflector 82 positioned on an inside surface of the second eyeball housing element 72. The first reflector 80 is held in place on the inner surface of the first eyeball housing element 71 by a protrusion 83 from the inside surface of the first eyeball housing element 71 which protrudes through and engages the walls of a corresponding opening 84 in the first reflector 80, and due to spring force exerted by the first reflector 80 against the inside surface of the first eyeball housing element 71 (e.g., the first reflector 80 is spring biased toward an orientation which is closer to flattened). The second reflector 81 is held in place in a similar way. The protrusion 83 is a "heat stake" feature which holds the split upper reflectors, and can be clearly seen poking through the circular opening 84 in the reflector 80. In manufacturing, this feature would be heated with a tool to "mushroom" over and hold the reflector in place.

The third reflector 82 is held in place on the inner surface of the second eyeball housing element 72 by a pair of tabs 85 which are integral with the second eyeball housing element 72 and which extend through openings 86 in flanges 87 which are integral with the third reflector 82. The first, second and/or third reflectors can further be adhered to the respective surfaces with which they are in contact by an adhesive or glue.

The eyeball accessory 70 further comprises an eyeball accessory diffuser 88 (see FIG. 11) positioned within a peripheral interior surface of the second eyeball housing element 72. The eyeball accessory diffuser 88 has a peripheral external edge, and three diffuser retention members (only a first diffuser retention member 89 is visible in FIG. 11) extend from the peripheral external edge. The diffuser retention member 89 is in contact with a diffuser contact member 90 (depicted in FIG. 11) which extends from the peripheral interior surface of the second eyeball housing element 72.

Figure 13:
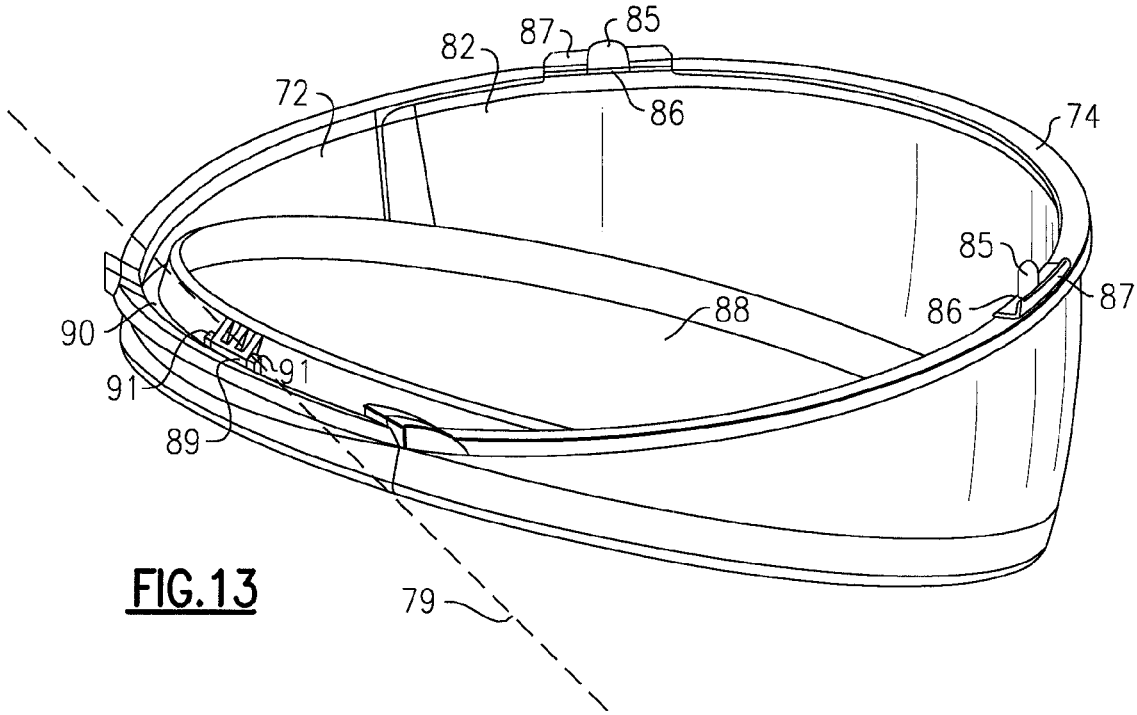
FIG. 13 depicts an alternative embodiment of a peripheral edge of a second eyeball housing element.

FIG. 13 depicts an alternative embodiment of a second eyeball housing element which has a peripheral interior surface which differs from that of the embodiment shown in FIG. 11. In FIG. 13, the peripheral interior surface is similar to the peripheral interior surface of the second eyeball housing element depicted in FIG. 11, except that the peripheral interior surface shown in FIG. 13 further includes two holding members 91 which, when an eyeball accessory diffuser as shown in FIG. 11 is positioned as shown in FIG. 11, the holding members 91 will be positioned on opposite sides of the diffuser retention member, whereby the holding members 91 will inhibit the eyeball accessory diffuser from rotating relative to the second eyeball housing element about an axis of the eyeball accessory diffuser.

Figure 14:
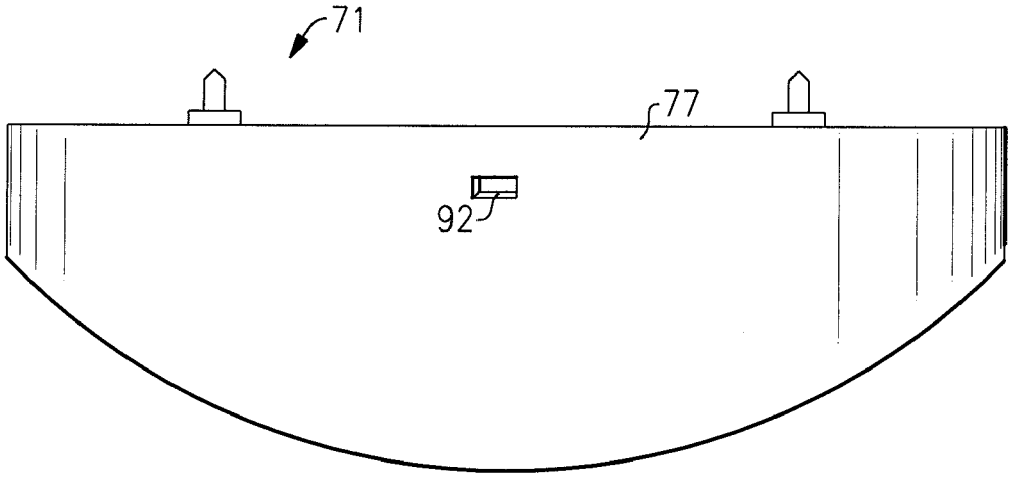
FIG. 14 depicts an alternative embodiment of a peripheral interior surface of a second eyeball housing element.

FIG. 14 depicts an embodiment of a second eyeball housing element which is similar to the embodiment depicted in FIG. 12, except that in the embodiment depicted in FIG. 14, instead of a protrusion for the surface irregularity 78, there is instead a recess 92.

Figure 15:
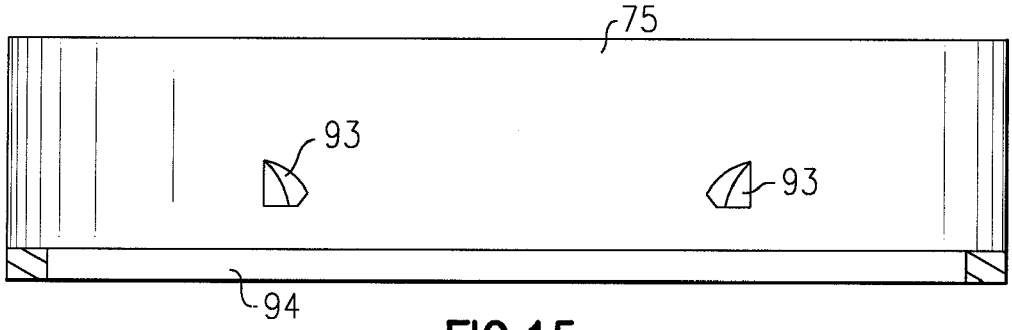
FIG. 15 is a sectional view showing the inner surface of the first eyeball housing element depicted in FIG. 10.

FIG. 15 is a sectional view showing the inner surface 75 of the first eyeball housing element 71, viewed from the surface irregularities 76. As shown in FIG. 15, the inner surface 75 of the first eyeball housing element 71 includes two surface irregularities 93 and a rib 94. With each of the surface irregularities 93, the lower (in the orientation shown in FIG. 15) portion protrudes farther than the upper portion.

Figure 16:
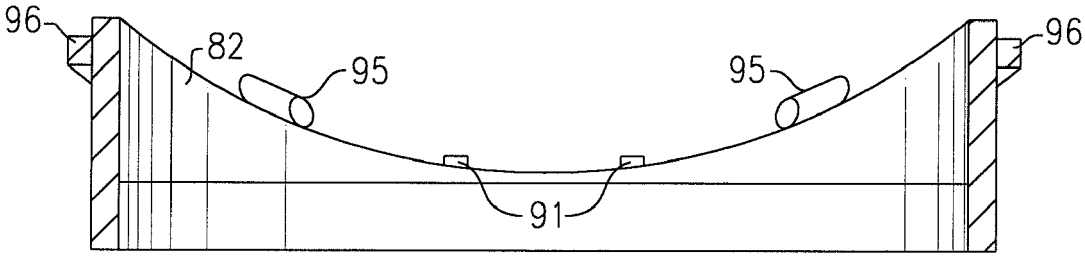
FIG. 16 is a sectional view of the second eyeball housing element depicted in FIG. 10.

FIG. 16 is a sectional view of the second eyeball housing element 72, viewed from the region opposite from the diffuser retention member 89. As shown in FIG. 16, the inner surface 82 of the second eyeball housing element 72 includes two surface irregularities 95 and a lip 96. In the orientation depicted in FIG. 16, the lip 96 is higher at locations closer to the viewer and lower on the opposite side (i.e., on the outside surface near the center of the second eyeball housing element 72 as positioned in FIG. 16), so that when the second eyeball housing element 72 is fully rotated, the lip 96 contacts the rib 94 around the entire circumference of the eyeball accessory 70. Each of the surface irregularities 95 includes a rounded surface, in the shape of an oblong cylinder.

When the eyeball accessory 70 is in the orientation depicted in FIG. 10 (i.e., with the second eyeball housing element rotated downward (in the orientation shown in FIG. 10)), the lip 96 rests on the rib 94 (preventing the second eyeball housing element from rotating downward any further) and the surface irregularities 95 are in contact with the surface irregularities 93. As the second eyeball housing element is rotated upward about the line 79 (shown in FIG. 11), the rounded portions of the surface irregularities 95 remain in contact with respective ones of the surface irregularities 93 and slide relative to one another.

As noted above, the first eyeball housing element 71 has a first peripheral edge 73. Referring to FIG. 10, the first peripheral edge 73 is in the shape of a circle with four gaps, each of the gaps being where a spring element 97 is located. Each spring element 97 is biased to a rest position where a portion of the spring element 97 extends inward from the first peripheral edge 73 when no pressure is applied to the spring element 97. If a force is applied to any of the spring elements 97 to push the spring element 97 outward relative to the internal area defined by the accessory peripheral edge, the spring element 97 flexes outward toward the peripheral edge 73, and if the force is removed, the spring element 97 flexes back toward the rest position.

As a result of this structure, if the eyeball accessory 70 is pushed toward a light fixture which comprises a circumferential hook element as shown in FIG. 5 (e.g., a light fixture which includes a diffuser as shown in FIGS. 1-4, or a light fixture which includes an attachment element as shown in FIGS. 8 and 9, or a light fixture in which a hook element is integrally formed, etc., the hook element having a diameter such that it fits snugly within the first peripheral edge 73 (as shown in FIG. 10), with the axis of the first peripheral edge 73 coaxial with an axis of the hook element, the spring elements 97 are pushed outward toward the first peripheral edge 73 due to contact between a first surface 98 of each spring element 97 (see FIG. 17) with the hook element. As the eyeball accessory is pushed farther, each spring element would reach a position where it is no longer pushed as far outward by the hook element, and would snap back toward its rest position (but not necessarily all the way to its rest position), whereby the eyeball accessory is held in place relative to the light fixture due to at least contact between the bottom (in the orientation shown in FIG. 10) of the spring elements 97 with the hook element.

Figure 17:
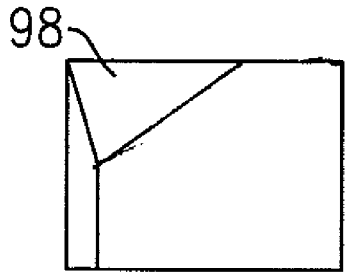
FIG. 17 is a front view of one of the spring elements in the embodiment depicted in FIG. 10 and a portion of a peripheral edge of an eyeball housing.

FIG. 17 is a front view showing one of the spring elements 97 in its rest position (FIG. 17 is a close-up view of the spring element shown in FIG. 10). The spring element 97 includes a sloped surface 98.

Figure 18:
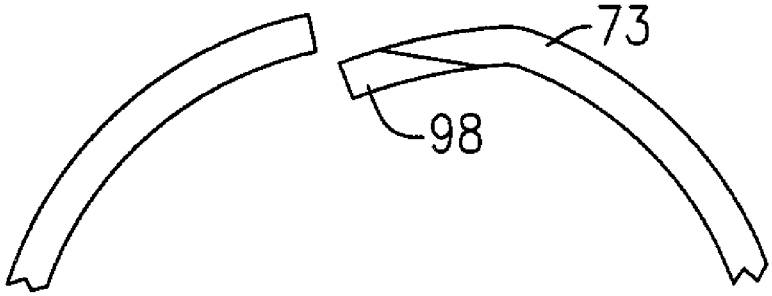
FIG. 18 is a top view of the spring element shown in FIG. 17 and portions of the peripheral edge of the eyeball housing.

FIG. 18 is a top view showing the spring element 97 shown in FIG. 17.

Figure 19:
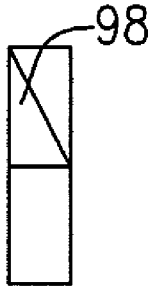
FIG. 19 is a left side view of the spring element shown in FIG. 17.

FIG. 19 is a left side view of the spring element 97 shown in FIG. 17. As a result of the contour of the sloped surface 98, the spring element 97 is pushed outward gradually as the eyeball accessory 70 is pushed into engagement with the hook element (or any other outwardly extending structure extending at least around a portion of the circumference of a structure which fits snugly inside or outside the periphery of the accessory).

Once the eyeball accessory 70 is engaged with the light fixture, the eyeball accessory is capable of being spun freely relative to the light fixture about an axis of the first peripheral edge 73.

Figure 20:
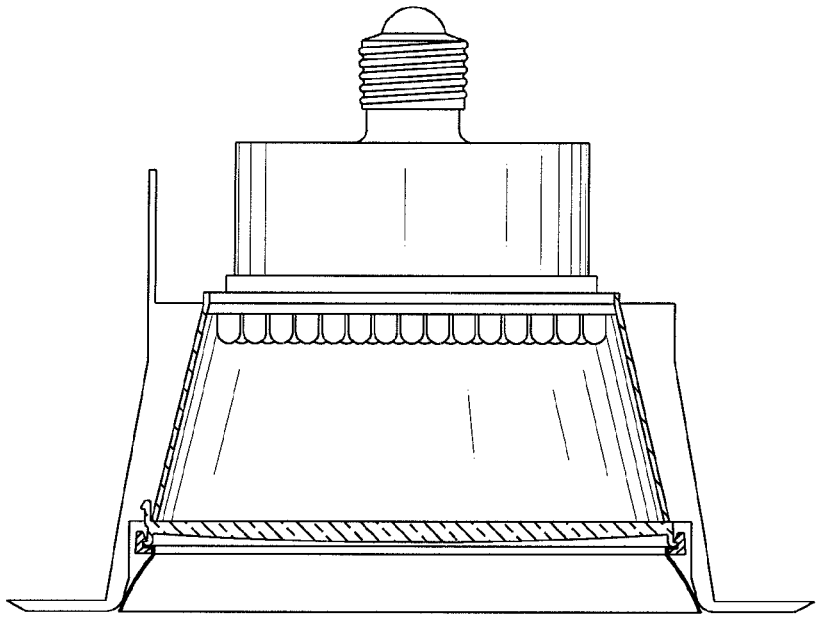
FIG. 20 is a sectional view showing a light fixture with an aesthetic trim accessory mounted thereon.

FIG. 20 is a sectional view showing a light fixture with an aesthetic trim accessory mounted thereon.

Figure 21:
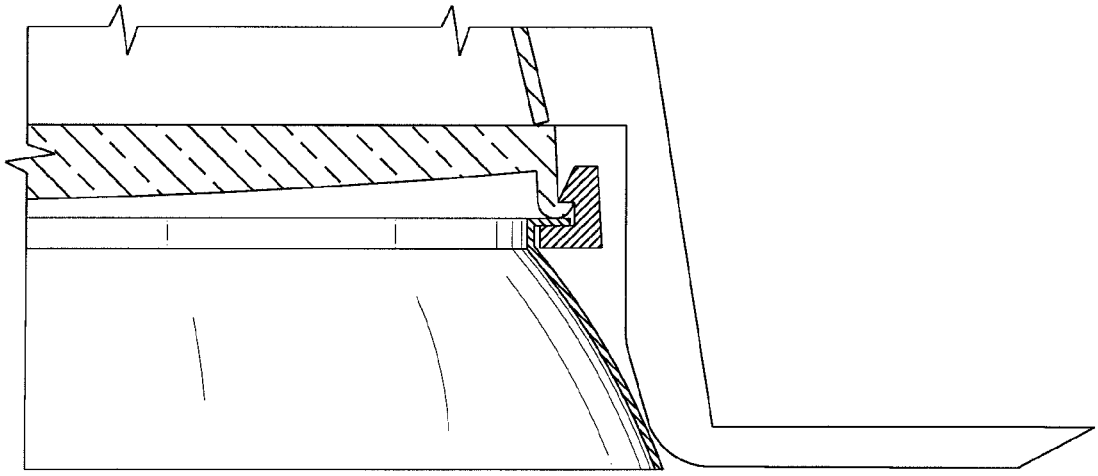
FIG. 21 is a close-up view of the engagement of the aesthetic trim accessory with a hook element.

FIG. 21 is a close-up view of the engagement of the aesthetic trim accessory with a hook element.

The trim depicted in FIGS. 20 and 21, which is concepted here as a thin gauge metal spinning, could be manufactured from a number of different materials and by different processes, which could include but would not be limited to spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), thermoset bulk molded compound or other composite material.

The aesthetic trim is attached to the fixture by means of the same "hook" feature on the diffuser (used by the eyeball), and an encompassing "snap ring" made of thermoplastic that would hold the aesthetic trim in place. Because the aesthetic trim is not required to spin freely as the eyeball is, the snap feature used by the snap ring can be of more standard construction.

Figure 31:
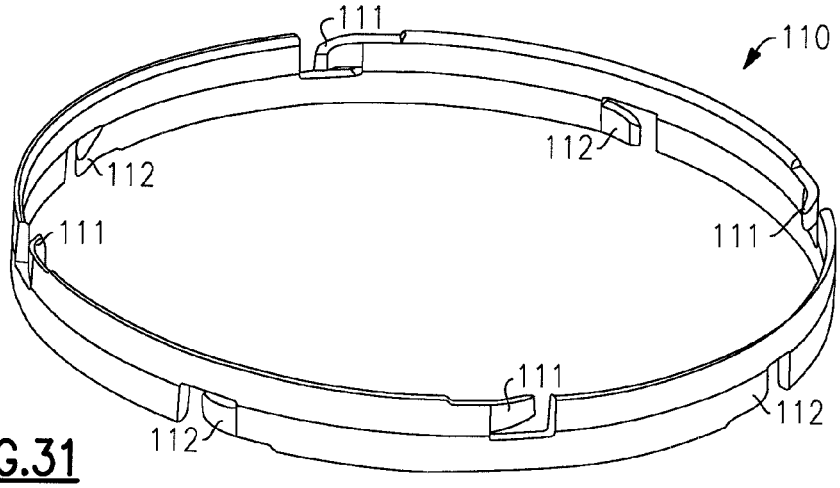
FIGS. 31 and 32 depict an alternative attachment ring for holding a trim to a diffuser or an attachment element.
Figure 32:
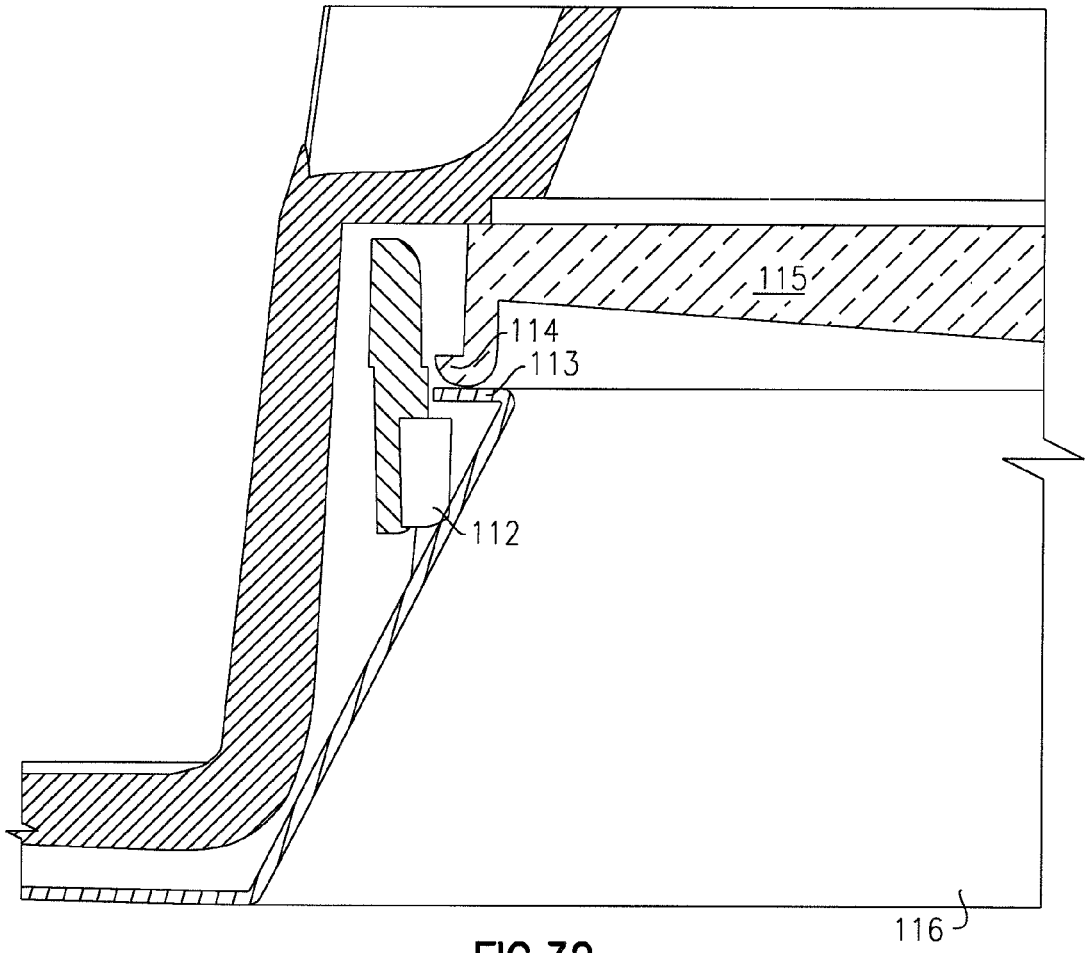

FIGS. 31 and 32 depict an alternative attachment ring for holding a trim to a diffuser or an attachment element. Referring to FIG. 31, there is provided an attachment ring 110 which includes a first set of spring elements 111 and a second set of spring elements 112. The attachment ring 110 can be attached to a diffuser or an attachment element by pushing the attachment ring 110 toward the hook element of the diffuser or attachment element so that the first set of spring elements 111 engage the hook element of the diffuser or attachment element in a manner similar to the way the spring elements 97 in the embodiment shown in FIG. 10 are described as being capable of engaging a hook element. The trim can be attached to the attachment ring 110 by pushing the trim, which includes a hook element of its own, such that the hook element of the trim engages the second set of spring elements 112 in a similar manner, thereby resulting in an arrangement as shown in FIG. 32, in which a hook element 113 of a trim 116 engages the spring elements 112 (only one being visible in FIG. 32) and the spring elements 111 (none visible in FIG. 32) engage the hook element 114 of a diffuser 115.

Figure 22:
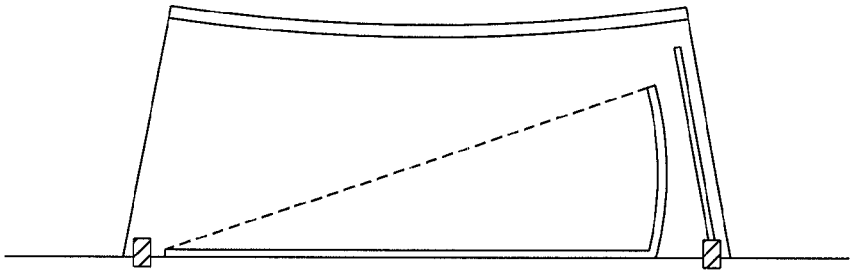
FIG. 22 is a conceptual view of an eyeball accessory according to the present inventive subject matter in a collapsed position.

FIG. 22 is a conceptual view of an eyeball accessory according to the present inventive subject matter in a collapsed position.

Figure 23:
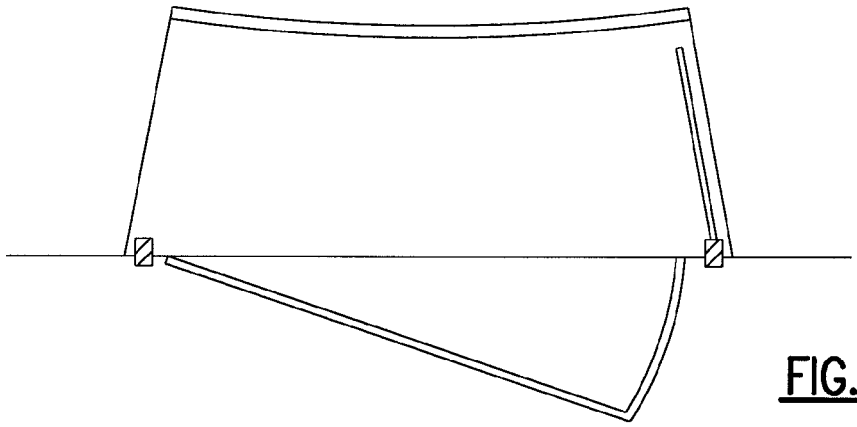
FIG. 23 is a conceptual view of the eyeball accessory of FIG. 22 in expanded position.

FIG. 23 is a conceptual view of the eyeball accessory of FIG. 22 in expanded position.

FIGS. 22 and 23 show the ability of the Fresnel lens to be positioned at a 30 degree disposition or less. In this embodiment, the accessory lens is able to be completely flush in the ceiling in its "stowed" position, and at 30 degrees in its "deployed" position.

Figure 24:
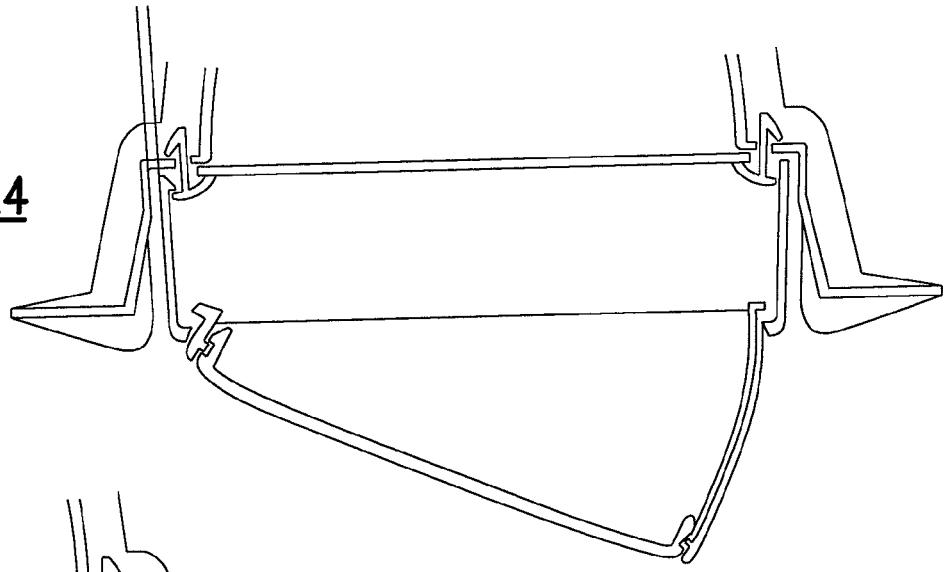
FIG. 24 is a conceptual view of an eyeball accessory and a light fixture according to the present inventive subject matter.

FIG. 24 is a conceptual view of an eyeball accessory and a light fixture according to the present inventive subject matter.

Figure 25:
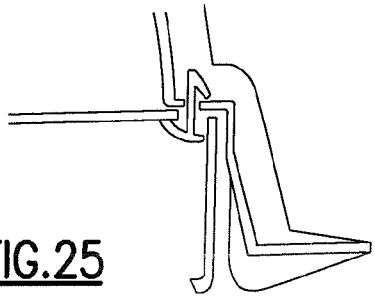
FIG. 25 is a close-up view of a portion of the apparatus shown in FIG. 24.

FIG. 25 is a close-up view of a portion of the apparatus shown in FIG. 24.

FIGS. 24 and 25 show an embodiment which includes detail for the features holding the bezel into the lower housing, and showing a single section (and a horizontal lower bezel surface) where the adjustment can only be between 20 and 30 degrees for the Fresnel lens.

Figure 26:
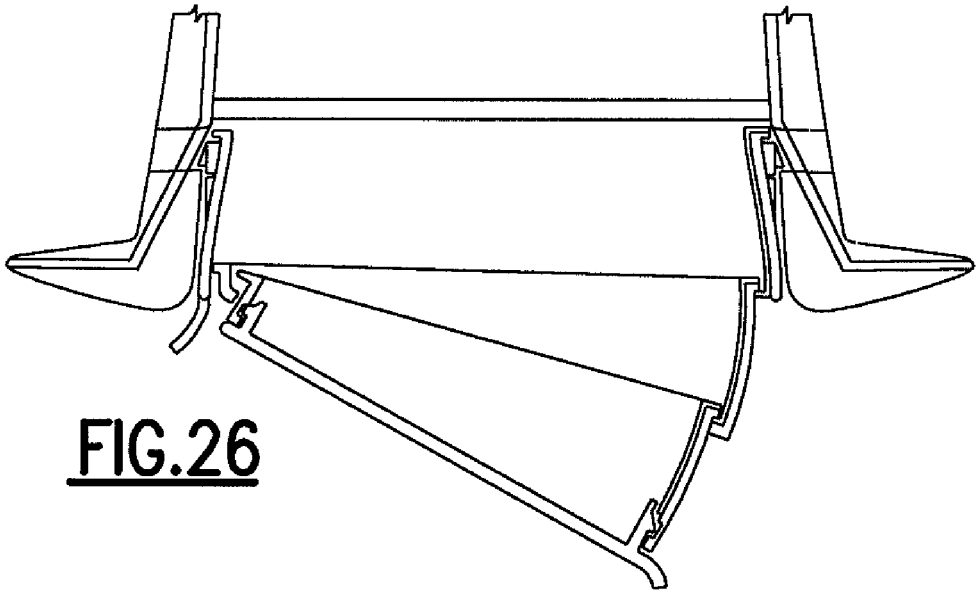
FIG. 26 is a conceptual view of an eyeball accessory according to the present inventive subject matter.

FIG. 26 is a conceptual view of an eyeball accessory according to the present inventive subject matter.

Figure 27:
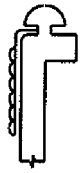
FIG. 27 is a detail view of an extender containing surface irregularities for use in embodiments according to the present inventive subject matter.

FIG. 27 is a detail view of an extender containing surface irregularities for use in embodiments according to the present inventive subject matter.

FIGS. 26 and 27 show an embodiment in which the Fresnel lens is completely flush with the ceiling, at the expense of added complexity, cost, and reduced lens area.

Figure 28:
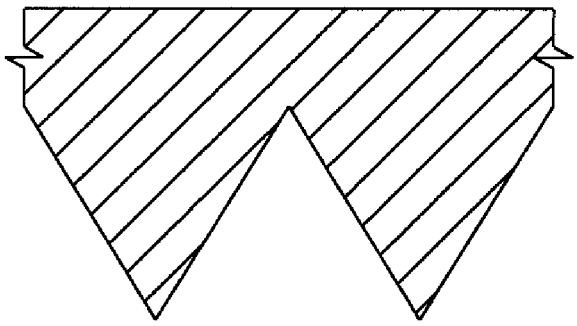
FIG. 28 is a cross-sectional view of a prism section for use according to the present inventive subject matter.

FIG. 28 is a cross-sectional view of a prism section for use according to the present inventive subject matter. FIG. 28 shows a Fresnel pattern designed to optimize the light extraction onto the adjacent wall.

Figure 29:
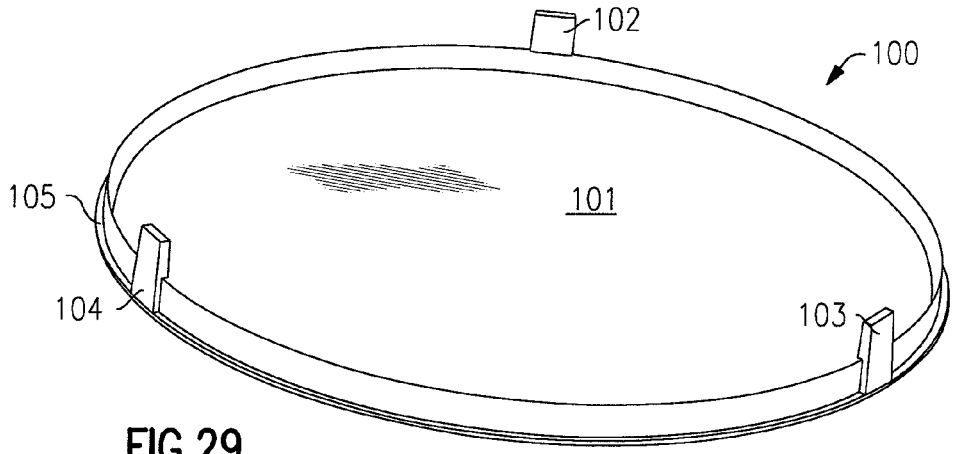
FIGS. 29-30 depict a second embodiment of a diffuser for a lighting device according to the present inventive subject matter.
Figure 30:
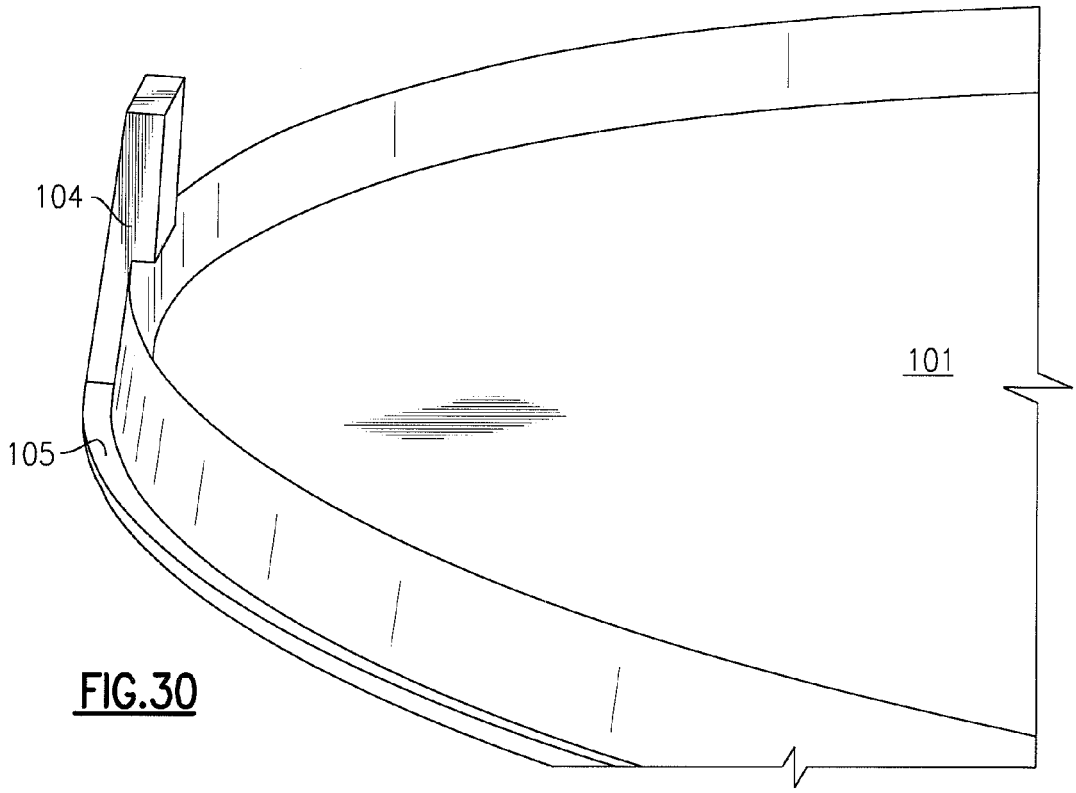

FIGS. 29-30 depict a second embodiment of a diffuser for a lighting device according to the present inventive subject matter.

Referring to FIG. 29, the diffuser 100 comprises a diffuser region 101, a first nose element precursor 102, a second nose element precursor 103 and a third nose element precursor 104.

In order to attach the diffuser 100 to a housing, the diffuser 100 is positioned such that the nose element precursors 102, 103, 104 extend through openings in the housing, and then the tops of the nose element precursors are melted (e.g., by bringing a heated element into contact with them to melt and "heat stake" them) so that each of them mushroom, thereby becoming a nose element, i.e., taking on a form in which, as above, their widest part extends farther in a first direction (along a line which extends perpendicular to an axis which passes through the nose element precursor) than the connection region (i.e., the portion which connects the mushroomed portion to the diffuser) extends in a second direction (parallel to the first direction, along a line which also extends perpendicular to the axis).

As can also be seen in FIG. 29, the diffuser 100 also comprises a circumferential hook element 105, a portion of which extends farther in a third direction (along a line which extends perpendicular to the first axis) than the diffuser extends in a fourth direction (parallel to the third direction, along a line which also extends perpendicular to the first axis).

Any two or more structural parts of the devices described herein can be integrated. Any structural part of the devices described herein can be provided in two or more parts (which can be held together, if necessary).

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A diffuser for a lighting device, said diffuser comprising a diffuser region, a hook element, at least a first nose element, a first connection region and a second connection region, said first connection region attached to said diffuser region, said first nose element attached to said first connection region, said second connection region attached to said diffuser region, said hook element attached to said second connection region, said nose element extending farther in a first direction than said first connection region extends in a second direction, said first direction parallel to said second direction, said first direction and said second direction each perpendicular to a first axis which passes through at least a portion of each of said first nose element and said first connection region, at least a portion of said hook element extending farther in a third direction than said second connection region extends in a fourth direction, said third direction and said fourth direction each perpendicular to a second axis which passes through at least a portion of each of said hook element and said second connection region, wherein if light passes through said diffuser region, said light would be diffused by passing through said diffuser region.

2. A diffuser as recited in claim 1, wherein a major dimension of said diffuser region extends in a first plane, said first plane perpendicular to said first axis.

3. A diffuser as recited in claim 1, wherein said hook element extends around an entire periphery of said diffuser.

4. A diffuser as recited in claim 3, wherein said periphery is substantially circular.

5. A diffuser as recited in claim 1, wherein a surface of said diffuser region is substantially circular.

6. A diffuser as recited in claim 1, wherein said diffuser further comprises a second nose element, a third connection region, a third nose element and a fourth connection region, said third connection region extending from said diffuser region to said second nose element, said fourth connection region extending from said diffuser region to said third nose element.

7. A light fixture, comprising:

a light engine housing, said light engine housing defining at least a first opening; and a diffuser, said diffuser comprising a diffuser region, at least a first nose element and a first connection region, said first connection region attached to said diffuser region, said first nose element attached to said first connection region, said nose element extending farther in a first direction than said first connection region extends in a second direction, said first direction parallel to said second direction, said first direction and said second direction each perpendicular to a first axis which passes through at least a portion of each of said first nose element and said first connection region, said first nose element on an opposite side of said first opening relative to said first hook element, said first connection portion extending through said first opening, wherein if light passes through said diffuser region, said light would be diffused by passing through said diffuser region.

8. A light fixture as recited in claim 7, wherein:

said diffuser further comprises a hook element and a second connection region, said second connection region is attached to said diffuser region, said hook element is attached to said second connection region, at least a portion of said hook element extends farther in a third direction than said second connection region extends in a fourth direction, and said third direction and said fourth direction are each perpendicular to a second axis which passes through at least a portion of each of said hook element and said second connection region.

9. A diffuser as recited in claim 8, wherein said hook element extends around an entire periphery of said diffuser.

10. A diffuser as recited in claim 9, wherein said periphery is substantially circular.

11. A light fixture as recited in claim 7, wherein a major dimension of said diffuser region extends in a first plane, said first plane perpendicular to said first axis.

12. A light fixture as recited in claim 7, wherein a surface of said diffuser region is substantially circular.

13. A light fixture as recited in claim 7, wherein said diffuser further comprises a second nose element, a third connection region, a third nose element and a fourth connection region, said third connection region extending from said diffuser region to said second nose element, said fourth connection region extending from said diffuser region to said third nose element.

14. A light fixture, comprising:

a light engine housing, said light engine housing defining at least a first opening;

a diffuser; and at least one accessory, said diffuser comprising a diffuser region, at least a first nose element, a first connection region, a hook element and a second connection region, said diffuser comprising a first peripheral edge;

said first connection region attached to said diffuser region, said first nose element attached to said first connection region, said second connection region attached to said diffuser region, said hook element attached to said second connection region, said nose element extending farther in a first direction than said first connection region extends in a second direction, said first direction parallel to said second direction, said first direction and said second direction each perpendicular to a first axis which passes through at least a portion of each of said first nose element and said first connection region, said first nose element on an opposite side of said first opening relative to said first hook element, said first connection portion extending through said first opening, at least a portion of said hook element extending farther in a third direction than said second connection region extends in a fourth direction, said third direction and said fourth direction each perpendicular to a second axis which passes through at least a portion of each of said hook element and said second connection region, wherein if light passes through said diffuser region, said light would be diffused by passing through said diffuser region, said accessory comprising a second peripheral edge and at least a first spring element, said first spring element in a first position in which it extends away from said second peripheral edge when no pressure is applied to said first spring element, wherein if said accessory is pushed toward said diffuser such that a first region surrounded by said first peripheral edge of said diffuser at least partially overlaps a second region surrounded by said second peripheral edge of said accessory, said first spring element would be pushed toward said second peripheral edge due to contact between a first surface of said first spring element with said hook element, and if said accessory is pushed further, said first spring element would reach a position relative to said hook element where said first spring element can move at least partially back toward said first position such that a second surface of said first spring element would come into contact with said hook element, whereby said accessory would be held in place relative to said diffuser due to at least contact between said second surface of said first spring element and said hook element.

15. A light fixture as recited in claim 14, wherein said first spring element is biased to extend inward from said second peripheral edge when no pressure is applied to said first spring element, wherein if said accessory is pushed toward said diffuser such that said first region surrounded by said first peripheral edge of said diffuser at least partially overlaps said second region surrounded by said second peripheral edge of said accessory, said first spring element would be pushed outward toward said second peripheral edge due to contact between said first surface of said first spring element with said hook element, and if said accessory is pushed further, said first spring element would reach a position where it is no longer pushed outward by contact with said hook element, and said first spring element would return toward said first position, such that said first spring element would extend inward from said second peripheral edge and a second surface of said first spring element would be in contact with said hook element, whereby said accessory would be held in place relative to said diffuser due to at least contact between said second surface of said first spring element and said hook element.

16. A light fixture as recited in claim 14, wherein said first spring element is biased to extend outward from said second peripheral edge when no pressure is applied to said first spring element, wherein if said accessory is pushed toward said diffuser such that said first region surrounded by said first peripheral edge of said diffuser at least partially overlaps said second region surrounded by said second peripheral edge of said accessory, said first spring element would be pushed inward toward said second peripheral edge due to contact between said first surface of said first spring element with said hook element, and if said accessory is pushed further, said first spring element would reach a position where it is no longer pushed inward by contact with said hook element, and said first spring element would return toward said first position, such that said first spring element would extend outward from said second peripheral edge and a second surface of said first spring element would be in contact with said hook element, whereby said accessory would be held in place relative to said diffuser due to at least contact between said second surface of said first spring element and said hook element.

17. A light fixture as recited in claim 14, wherein said accessory is rotatable relative to said light engine housing.

18. A light fixture as recited in claim 14, wherein said first peripheral edge and said second peripheral edge are each substantially circular.

19. A light fixture as recited in claim 18, wherein said accessory is rotatable relative to said light engine housing about an axis extending through a center of a circle defined by said first peripheral edge.

20. A light fixture as recited in claim 15, wherein if said diffuser is positioned such that a first plane defined by a surface of said diffuser region is substantially level, said first spring element would be pushed in a direction which is substantially parallel to said first plane, and said accessory would be held in place relative to said diffuser as a result of at least gravitational force pulling said second surface of said first spring element toward said hook element.

21. A light fixture as recited in claim 15, wherein said first spring element comprises at least a third surface which is sloped such that said first spring element would be pushed outward or inward gradually as said accessory is pushed toward said diffuser such that said first region surrounded by said first peripheral edge of said diffuser would at least partially overlap a second region surrounded by said second peripheral edge of said accessory.

22. A light fixture as recited in claim 14, wherein said accessory comprises at least said first spring element, a second spring element and a third spring element.

23. A light fixture as recited in claim 14, wherein a surface of said diffuser region extends in a first plane, said first plane perpendicular to said first axis.

24. A light fixture as recited in claim 14, wherein a surface of said diffuser region is substantially circular.

25. A light fixture as recited in claim 14, wherein said hook element extends around an entire periphery of said diffuser.

26. A light fixture as recited in claim 14, wherein said diffuser further comprises a second nose element, a third connection region, a third nose element and a fourth connection region, said third connection region extending from said diffuser region to said second nose element, said fourth connection region extending from said diffuser region to said third nose element.

27. A light fixture as recited in claim 14, wherein said accessory comprises a trim and an attachment ring, the attachment ring comprising at least a first element which engages said trim.

28. A light fixture structure, comprising:

a light engine housing, said light engine housing defining at least a first opening; and at least a first attachment element, said first attachment element comprising at least a first nose element, a hook element and a first connection region, said first connection region extending from said first nose element to said hook element, said first nose element extending farther in a first direction than said first connection region extends in a second direction, said first direction parallel to said second direction, said first direction and said second direction each perpendicular to a first axis which passes through at least a portion of each of said first nose element and said first connection region, said first nose element on an opposite side of said first opening relative to said hook element, said first connection region extending through said first opening, at least a portion of said hook element extending farther in a third direction than said first connection region extends in said second direction, said third direction also perpendicular to said first axis.

29. A light fixture structure as recited in claim 28, wherein an edge of said hook element extends around an entire periphery of said attachment element, said periphery of said attachment element substantially circular.

30. A light fixture, comprising:

a light engine housing, said light engine housing defining at least a first opening;

a diffuser, said diffuser comprising a diffuser region; and at least a first attachment element, said first attachment element comprising at least a first nose element, a hook element and a first connection region, said first connection region extending from said first nose element to said hook element, said first nose element extending farther in a first direction than said first connection region extends in a second direction, said first direction parallel to said second direction, said first direction and said second direction each perpendicular to a first axis which passes through at least a portion of each of said first nose element and said first connection region, said first nose element on an opposite side of said first opening relative to said hook element, said first connection region extending through said first opening, at least a portion of said hook element extending farther in a third direction than said first connection region extends in said second direction, said third direction also perpendicular to said first axis, at least a first surface of said diffuser in contact with a portion of said hook element, wherein if light passes through said diffuser region, said light would be diffused by passing through said diffuser region.

31. A light fixture as recited in claim 30, wherein a major dimension of said diffuser region extends in a first plane, said first plane perpendicular to said first axis.

32. A light fixture as recited in claim 30, wherein an edge of said hook element extends around an entire periphery of said attachment element, said periphery of said attachment element substantially circular.

33. A light fixture as recited in claim 30, wherein a surface of said diffuser region is substantially circular.

34. A light fixture as recited in claim 30, wherein said attachment element comprises at least said nose element, a second nose element and a third nose element.

35. A light fixture, comprising:

a light engine housing, said light engine housing defining at least a first opening;

a diffuser;

at least a first attachment element; and at least one accessory, said diffuser comprising a diffuser region, said first attachment element comprising at least a first nose element, a hook element and a first connection region, said first connection region extending from said first nose element to said hook element, said first attachment element comprising a first peripheral edge;

said first nose element extending farther in a first direction than said first connection region extends in a second direction, said first direction parallel to said second direction, said first direction and said second direction each perpendicular to a first axis which passes through at least a portion of each of said first nose element and said first connection region, said first nose element on an opposite side of said first opening relative to said hook element, said first connection region extending through said first opening, at least a portion of said hook element extending farther in a third direction than said first connection region extends in said second direction, said third direction also perpendicular to said first axis, at least a first surface of said diffuser in contact with a first portion of said hook element, wherein if light passes through said diffuser region, said light would be diffused by passing through said diffuser region, said accessory comprising a second peripheral edge and at least a first spring element, said accessory held in place relative to said diffuser by at least said first spring element, said accessory being of a shape such that if said accessory were not engaged with said diffuser, said first spring element would be in a first position in which it extends away from said second peripheral edge when no pressure is applied to said first spring element, wherein if said accessory is pushed toward said attachment element such that a first region surrounded by said first peripheral edge of said attachment element at least partially overlaps a second region surrounded by said second peripheral edge of said accessory, said first spring element would be pushed toward said second peripheral edge due to contact between a first surface of said first spring element with said hook element, and if said accessory is pushed further, said first spring element would reach a position relative to said hook element where said first spring element can move at least partially back toward said first position such that a second surface of said first spring element would come into contact with said hook element, whereby said accessory would be held in place relative to said attachment element due to at least contact between said second surface of said first spring element and said hook element.

36. A light fixture as recited in claim 35, wherein said first spring element is biased to extend inward from said second peripheral edge when no pressure is applied to said first spring element, wherein if said accessory is pushed toward said attachment element such that a first region surrounded by said first peripheral edge of said attachment element at least partially overlaps a second region surrounded by said second peripheral edge of said accessory, said first spring element would be pushed outward toward said second peripheral edge due to contact between said first surface of said first spring element with said hook element, and if said accessory is pushed further, said first spring element would reach a position where it is no longer pushed outward by contact with said hook element, and said first spring element would return toward said first position, such that said first spring element would extend inward from said second peripheral edge and a second surface of said first spring element would be in contact with said hook element, whereby said accessory would be held in place relative to said attachment element due to at least contact between said second surface of said first spring element and said hook element.

37. A light fixture as recited in claim 35, wherein said first spring element is biased to extend outward from said second peripheral edge when no pressure is applied to said first spring element, wherein if said accessory is pushed toward said attachment element such that said first peripheral edge of said attachment element passes through said second peripheral edge of said accessory, said first spring element would be pushed inward toward said second peripheral edge due to contact between said first surface of said first spring element with said hook element, and if said accessory is pushed further, said first spring element would reach a position where it is no longer pushed inward by contact with said hook element, and said first spring element would return toward said first position, such that said first spring element would extend outward from said second peripheral edge and a second surface of said first spring element would be in contact with said hook element, whereby said accessory would be held in place relative to said attachment element due to at least contact between said second surface of said first spring element and said hook element.

38. A light fixture as recited in claim 35, wherein said accessory is rotatable relative to said light engine housing.

39. A light fixture as recited in claim 35, wherein said first spring element comprises at least a third surface which is sloped such that said first spring element would be pushed gradually as said accessory is pushed toward said attachment element such that said first region surrounded by said first peripheral edge of said attachment element at least partially overlaps said second region surrounded by said second peripheral edge of said accessory.

40. A light fixture as recited in claim 35, wherein said accessory comprises at least said first spring element, a second spring element and a third spring element.

41. A light fixture as recited in claim 35, wherein a first plane defined by said first peripheral edge of said attachment element is substantially perpendicular to said first axis.

42. A light fixture as recited in claim 41, wherein said first peripheral edge of said attachment element is substantially circular.

43. A light fixture, comprising:

a light engine housing, said light engine housing defining at least a first opening;

a diffuser; and an attachment ring said diffuser comprising a diffuser region, at least a first nose element, a first connection region, a diffuser hook element and a second connection region, said diffuser comprising a first peripheral edge;

said first connection region attached to said diffuser region, said first nose element attached to said first connection region, said second connection region attached to said diffuser region, said diffuser hook element attached to said second connection region, said nose element extending farther in a first direction than said first connection region extends in a second direction, said first direction parallel to said second direction, said first direction and said second direction each perpendicular to a first axis which passes through at least a portion of each of said first nose element and said first connection region, said first nose element on an opposite side of said first opening relative to said diffuser hook element, said first connection portion extending through said first opening, at least a portion of said diffuser hook element extending farther in a third direction than said second connection region extends in a fourth direction, said third direction and said fourth direction each perpendicular to a second axis which passes through at least a portion of each of said diffuser hook element and said second connection region, wherein if light passes through said diffuser region, said light would be diffused by passing through said diffuser region, said attachment ring comprising a first set of spring elements and a second set of spring elements, said first set of spring elements engaging said diffuser hook element.

44. A light fixture as recited in claim 43, wherein:

said light fixture further comprises a trim, said trim comprises a trim hook element, and said second set of spring elements engage said trim hook element.

45. A light fixture, comprising:

a light engine housing, said light engine housing defining at least a first opening;

a diffuser; and an attachment ring, said diffuser comprising a diffuser region, at least a first nose element, a first connection region, a diffuser hook element and a second connection region, said diffuser comprising a first peripheral edge;

said first connection region attached to said diffuser region, said first nose element attached to said first connection region, said second connection region attached to said diffuser region, said diffuser hook element attached to said second connection region, said nose element extending farther in a first direction than said first connection region extends in a second direction, said first direction parallel to said second direction, said first direction and said second direction each perpendicular to a first axis which passes through at least a portion of each of said first nose element and said first connection region, said first nose element on an opposite side of said first opening relative to said diffuser hook element, said first connection portion extending through said first opening, at least a portion of said diffuser hook element extending farther in a third direction than said second connection region extends in a fourth direction, said third direction and said fourth direction each perpendicular to a second axis which passes through at least a portion of each of said diffuser hook element and said second connection region, wherein if light passes through said diffuser region, said light would be diffused by passing through said diffuser region, said attachment ring comprising a first set of spring elements and a second set of spring elements, said first set of spring elements engaging said diffuser hook element;

at least a first spring element of said second set of spring elements in a first position in which it extends away from a peripheral edge of said attachment ring when no pressure is applied to said first spring element, wherein if a trim which has a circumferential trim hook element is pushed toward said attachment ring such that a first region surrounded by said first peripheral edge of said attachment ring at least partially overlaps a second region surrounded by a peripheral edge of said trim, said first spring element would be pushed toward said second peripheral edge due to contact between a first surface of said first spring element with said trim hook element, and if said trim is pushed further, said first spring element would reach a position relative to said trim hook element where said first spring element can move at least partially back toward said first position such that a second surface of said first spring element would come into contact with said trim hook element, whereby said trim would be held in place relative to said diffuser due to at least contact between said second surface of said first spring element and said trim hook element.

46. A light fixture, comprising:

a light engine housing, said light engine housing defining at least a first opening;

a diffuser;

an attachment element;

an attachment ring; and a trim, said diffuser comprising a diffuser region, said first attachment element comprising at least a first nose element, an attachment element hook element and a first connection region, said first connection region extending from said first nose element to said attachment element hook element, said first attachment element comprising a first peripheral edge;

said first nose element extending farther in a first direction than said first connection region extends in a second direction, said first direction parallel to said second direction, said first direction and said second direction each perpendicular to a first axis which passes through at least a portion of each of said first nose element and said first connection region, said first nose element on an opposite side of said first opening relative to said attachment element hook element, said first connection region extending through said first opening, at least a portion of said attachment element hook element extending farther in a third direction than said first connection region extends in said second direction, said third direction also perpendicular to said first axis, at least a first surface of said diffuser in contact with a first portion of said attachment element hook element, wherein if light passes through said diffuser region, said light would be diffused by passing through said diffuser region, said attachment ring comprising a first set of spring elements and a second set of spring elements, said first set of spring elements engaging said attachment element hook element;

at least a first spring element of said second set of spring elements in a first position in which it extends away from a peripheral edge of said attachment ring when no pressure is applied to said first spring element, wherein if a trim which has a circumferential trim hook element is pushed toward said attachment ring such that a first region surrounded by said first peripheral edge of said attachment ring at least partially overlaps a second region surrounded by a peripheral edge of said trim, said first spring element would be pushed toward said second peripheral edge due to contact between a first surface of said first spring element with said trim hook element, and if said trim is pushed further, said first spring element would reach a position relative to said trim hook element where said first spring element can move at least partially back toward said first position such that a second surface of said first spring element would come into contact with said trim hook element, whereby said trim would be held in place relative to said attachment ring due to at least contact between said second surface of said first spring element and said trim hook element.

* * * * *